US009752217B2

(12) United States Patent
Yokoi et al.

(10) Patent No.: US 9,752,217 B2
(45) **Date of Patent: *Sep. 5, 2017**

(54) HOT-ROLLED STEEL SHEET AND METHOD OF PRODUCING THE SAME

(75) Inventors: Tatsuo Yokoi, Tokyo (JP); Hiroshi Shuto, Tokyo (JP); Riki Okamoto, Tokyo (JP); Nobuhiro Fujita, Tokyo (JP); Kazuaki Nakano, Tokyo (JP); Takeshi Yamamoto, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 903 days.

This patent is subject to a terminal disclaimer.

(21) Appl. No.: 14/008,205

(22) PCT Filed: Apr. 13, 2012

(86) PCT No.: PCT/JP2012/060132

§ 371 (c)(1),
(2), (4) Date: Sep. 27, 2013

(87) PCT Pub. No.: WO2012/141290

PCT Pub. Date: Oct. 18, 2012

(65) Prior Publication Data

US 2014/0014237 A1 Jan. 16, 2014

(30) Foreign Application Priority Data

Apr. 13, 2011 (JP) ..... 2011-089520

(51) Int. Cl.
*C21D 8/02* (2006.01)
*C22C 38/00* (2006.01)
(Continued)

(52) U.S. Cl.
CPC ..... *C22C 38/34* (2013.01); *C21D 8/0226* (2013.01); *C21D 8/0263* (2013.01);
(Continued)

(58) Field of Classification Search
CPC ..... C21D 8/0226
(Continued)

(56) References Cited

U.S. PATENT DOCUMENTS 4,769,088 A * 9/1988 Itami ..... C21D 8/0226 148/602
6,290,784 B1 9/2001 Yasuhara et al.
(Continued)

FOREIGN PATENT DOCUMENTS

CN 1599802 A 3/2005
CN 1989267 A 6/2007
(Continued)

OTHER PUBLICATIONS

Taiwanese Office Action for Taiwanese Application No. 101113229 dated Dec. 10, 2013 (with English translation).
(Continued)

*Primary Examiner* — Jessee Roe
*Assistant Examiner* — Jeremy Jones
(74) *Attorney, Agent, or Firm* — Birch, Stewart, Kolasch & Birch, LLP

(57) ABSTRACT

In a hot-rolled steel sheet, an average pole density of an orientation group {100}<011> to {223}<110>, which is represented by an arithmetic mean of pole densities of orientations {100}<011>, {116}<110>, {114}<110>, {112}<110>, and {223}<110> is 1.0 to 4.0 and a pole density of a crystal orientation {332}<113> is 1.0 to 4.8, in a thickness center portion which is a thickness range of ⅝ to ⅜ from the surface of the steel sheet; an average grain size in the thickness center portion is less than or equal to 10 μm and a grain size of cementite precipitating in a grain boundary of the steel sheet is less than or equal to 2 μm; and an average grain size of precipitates containing TiC in grains is
(Continued)

less than or equal to 3 nm and a number density per unit volume is greater than or equal to $1\times10^{16}$ grains/cm$^3$.

20 Claims, 2 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/28*** | (2006.01) |
| ***C22C 38/34*** | (2006.01) |
| ***C22C 38/38*** | (2006.01) |

(52) U.S. Cl.
CPC ..... *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/28* (2013.01); *C22C 38/38* (2013.01); *C21D 2211/003* (2013.01); *C21D 2211/004* (2013.01)

(58) Field of Classification Search
USPC ..... 148/504
See application file for complete search history.

(56) References Cited

U.S. PATENT DOCUMENTS

| | | | | |
|---|---|---|---|---|
| 2001/0004910 | A1* | 6/2001 | Yasuhara | C21D 8/0226 148/546 |
| 2004/0069382 | A1* | 4/2004 | Yokoi | C21D 8/0226 148/650 |
| 2004/0244877 | A1 | 12/2004 | Yokoi et al. | |
| 2008/0008901 | A1 | 1/2008 | Sugiura et al. | |
| 2009/0223609 | A1* | 9/2009 | Hakomori | C21D 6/002 148/602 |
| 2010/0047617 | A1* | 2/2010 | Sugiura | C21D 6/005 428/659 |
| 2012/0138197 | A1 | 6/2012 | Kohsaka et al. | |

FOREIGN PATENT DOCUMENTS

| | | | | |
|---|---|---|---|---|
| CN | 101535519 | A | | 9/2009 | |
| CN | 101748347 | A | | 6/2010 | |
| EP | 2116624 | A1 | | 11/2009 | |
| JP | 6-293910 | A | | 10/1994 | |
| JP | 9-49065 | A | | 2/1997 | |
| JP | 10-183255 | A | | 7/1998 | |
| JP | 2000-297350 | A | | 10/2000 | |
| JP | 2002-322540 | A | | 11/2002 | |
| JP | 2002-322541 | A | | 11/2002 | |
| JP | 2004-2934 | A | | 1/2004 | |
| JP | 2004-131754 | A | | 4/2004 | |
| JP | 2006-124789 | A | | 5/2006 | |
| JP | 2006-193819 | A | | 7/2006 | |
| JP | 2008-189978 | A | | 8/2008 | |
| JP | 2008274355 | A | * | 11/2008 | |
| JP | 2009-068057 | A | | 4/2009 | |
| JP | 2009-68507 | A | | 4/2009 | |
| JP | 2009-132988 | A | | 6/2009 | |
| JP | 2009-263715 | A | | 11/2009 | |
| JP | 2009-263718 | A | | 11/2009 | |
| JP | 2011-12308 | A | | 1/2011 | |
| JP | 2011-17044 | A | | 1/2011 | |
| JP | 2011-26690 | A | | 2/2011 | |
| JP | 2012062561 | A | * | 3/2012 | C21D 8/0226 |
| TW | 200517507 | A | | 6/2005 | |
| WO | WO 2010/131761 | A | | 11/2010 | |
| WO | WO 2012/014926 | A1 | | 2/2012 | |

OTHER PUBLICATIONS

Extended European Search Report dated Feb. 5, 2015, issued in European Patent Application No. 12771020.0.

Korean Notice of Allowance for counterpart Korean Application No. 10-2013-7027021, dated Jun. 22, 2015, with an English translation.

Korean Notice of Allowance for Korean Application No. 10-2013-7027173, dated Jun. 22, 2015, with an English translation.

Chinese Office Action and Search Report for Chinese Application No. 201280017163.X, dated Dec. 18, 2014, with an English translation.

Extended European Search Report for corresponding European Application No. 12771475.6, dated Jan. 27, 2015.

Taiwanese office Action dated Feb. 19, 2014, issued in Taiwanese Patent Application No. 101113231.

International Search Report Issued in PCT/JP2012/060132, mailed on Jul. 17, 2012.

International Search Report Issued in PCT/JP2012/060151, mailed on Jul. 17, 2012.

PCT/ISA/237—Mailed on Jul. 17, 2012, issued in PCT/JP2012/060132.

US Office Action dated Oct. 18, 2016, issued in U.S. Appl. No. 15/239,497.

* cited by examiner

HOT-ROLLED STEEL SHEET AND METHOD OF PRODUCING THE SAME

TECHNICAL FIELD

The present invention relates to a precipitation strengthening type high-strength hot-rolled steel sheet having superior isotropic workability and a method of producing the same.

Priority is claimed on Japanese Patent Application No. 2011-089520, filed Apr. 13, 2011, the content of which is incorporated herein by reference.

BACKGROUND ART

Recently, in order to reduce the weight of various components for the improvement of fuel efficiency of a vehicle, an application of a reduction in thickness by the strengthening of a steel sheet such as an iron alloy; and a light metal such as an Al alloy is progressed. However, compared to a heavy metal such as steel, a light metal such as an Al alloy has an advantage of high specific strength and a disadvantage of having a significantly higher cost. Therefore, the application is limited to specific uses. Therefore, in order to reduce the weight of various components at a lower cost over a wider range, a reduction in thickness with the strengthening of a steel sheet is necessary.

Generally, the strengthening of a steel sheet brings about a deterioration in material properties such as formability (workability). Therefore, in the development of a high-strength steel sheet, it is important to increase strength without impairing material properties. In particular, for a steel sheet which is used for vehicle components such as inner plate components, structural components, and suspension components, bendability, stretch flangeability, burring workability, ductility, fatigue resistance, impact resistance (toughness), corrosion resistance, and the like are required according to its use. Therefore, it is important to achieve a high level of balance between these material properties and high strength.

In particular, among automobile components, components which are processed using a sheet material as a base metal and function as a rotator, such as, a drum or a carrier constituting an automatic transmission are important components for transmitting engine output to axle shafts. In order to reduce friction and the like, circularity as a shape and homogeneity in thickness in a circumferential direction are required for these components. Furthermore, since a forming processes such as burring, drawing, ironing, and stretching are used for these components, ultimate deformability which is represented by local elongation is significantly important.

In a steel sheet used for these components, it is preferable that impact resistance (toughness), which is the property of a component to be difficult to fracture when being attached to a vehicle after formation and then being impacted by collision or the like, is improved. In particular, when use in a cold region is taken into consideration, in order to secure impact resistance at a low temperature, it is preferable that the toughness at a low temperature (low-temperature toughness) is improved. This toughness is defined by vTrs (Charpy fracture appearance transition temperature). Therefore, it is important to increase the above-described impact resistance of a steel material.

That is, in a thin steel sheet for components which require homogeneity in thickness and include the above-described components, in addition to superior workability, it is required that both plastic isotropy and toughness are simultaneously improved.

Techniques for improving both high strength and various material properties such as formability are as follows. For example, Patent Document 1 discloses a method of producing a steel sheet in which a steel structure contains 90% or greater of ferrite and the balance consisting of bainite; and thus high strength, ductility, and hole extensibility are simultaneously improved. However, regarding a steel sheet which is produced according to the technique disclosed in Patent Document 1, Patent Document 1 does not disclose plastic isotropy at all. Therefore, for example, assuming that this steel sheet is applied to a component, such as a gear wheel, which requires circularity and homogeneity of thickness in a circumferential direction, there is a concern about power reduction by inappropriate vibration or friction loss due to a misaligned component.

In addition, Patent Documents 2 and 3 disclose a high-tensile hot-rolled steel sheet having high strength and superior stretch flangeability in which Mo is added for refining precipitates. However, in a steel sheet which is produced according to the techniques disclosed in Patent Documents 2 and 3, since it is necessary that 0.07% or greater of Mo, which is an expensive alloy element, is added, there is a problem of high production cost. Furthermore, the techniques disclosed in Patent Documents 2 and 3 do not disclose plastic isotropy. Therefore, assuming that this steel sheet is applied to a component which requires circularity and homogeneity in thickness in a circumferential direction, there is a concern about power reduction by inappropriate vibration or friction loss due to a misaligned component.

Meanwhile, regarding the improvement of plastic isotropy of a steel sheet, that is, the reduction of plastic anisotropy, for example, Patent Document 4 discloses a technique in which endless rolling and lubrication rolling are combined to control an austenite texture of a surface shear layer and thus to reduce the in-plane anisotropy of r values (Lankford values). However, in order to perform such lubrication rolling having a low friction coefficient over the entire coil, endless rolling is necessary for preventing engagement failure caused by a slip between a roll caliber tool and a rolled material during rolling. Therefore, in order to apply this technique, there is a large burden because facilities such as a rough bar joining apparatus or a high-speed crop shear are required.

In addition, for example, Patent Document 5 discloses a technique in which a combination of Zr, Ti, and Mo is added; and finish rolling is finished at a high temperature of 950° C. or higher to reduce the anisotropy of r values at a strength of 780 MPa grade or higher and thus to improve both stretch flangeability and deep drawability. However, since it is necessary that 0.1% or greater of Mo which is an expensive alloy element, is added, there is a problem of high production cost.

Furthermore, although techniques of improving the toughness of a steel sheet have been progressed in the related art, a hot-rolled steel sheet having high strength and superior plastic isotropy, hole expansibility, and toughness is not disclosed in Patent Documents 1 to 5.

PRIOR ART DOCUMENT

Patent Document

[Patent Document 1] Japanese Unexamined Patent Application, First Publication No. H06-293910

[Patent Document 2] Japanese Unexamined Patent Application, First Publication No. 2002-322540

[Patent Document 3] Japanese Unexamined Patent Application, First Publication No. 2002-322541

[Patent Document 4] Japanese Unexamined Patent Application, First Publication No. H10-183255

[Patent Document 5] Japanese Unexamined Patent Application, First Publication No. 2006-124789

DISCLOSURE OF THE INVENTION

Problem that the Invention is to Solve

The present invention has been made in consideration of the above-described problems. That is, an object thereof is to provide a precipitation strengthening type high-strength hot-rolled steel sheet which has a high tensile strength of 540 MPa grade or higher, can be applied to components requiring workability such as hole expansibility, strict homogeneity in thickness and circularity after processing, and toughness, and has superior isotropic workability (isotropy); and a method capable of stably producing the steel sheet at a low cost.

Means for Solving the Problems

In order to solve the above-described problems and to achieve the object, the present invention adopts the following measures.

(1) That is, according to an aspect of the present invention, there is provided a hot-rolled steel sheet including, by mass %, C: a content [C] of 0.02% to 0.07%, Si: a content [Si] of 0.001% to 2.5%, Mn: a content [Mn] of 0.01% to 4%, Al: a content [Al] of 0.001% to 2%, Ti: a content [Ti] of 0.015% to 0.2%, P: a limited content [P] of 0.15% or less, S: a limited content [S] of 0.03% or less, N: a limited content [N] of 0.01% or less, and the balance consisting of Fe and unavoidable impurities, in which the contents [Ti], [N], [S], and [C] satisfy the following expressions (a) and (b); an average pole density of an orientation group {100}<011> to {223}<110>, which is represented by an arithmetic mean of pole densities of orientations {100}<011>, {116}<110>, {114}<110>, {112}<110>, and {223}<110> is 1.0 to 4.0 and a pole density of a crystal orientation {332}<113> is 1.0 to 4.8; in a thickness center portion which is a thickness range of ⅝ to ⅜ from the surface of the steel sheet, an average grain size in the thickness center portion is less than or equal to 10 μm and a grain size of a cementite precipitating in a grain boundary of the steel sheet is less than or equal to 2 μm; and an average grain size of precipitates containing TiC in grains is less than or equal to 3 nm and a number density per unit area is greater than or equal to $1\times10^{16}$ grains/cm$^3$.

$$0\% \leq ([Ti]-[N]\times48/14-[S]\times48/32) \quad (a)$$

$$0\% \leq [C]-12/48\times([Ti]-[N]\times48/14-[S]\times48/32) \quad (b)$$

(2) In the hot-rolled steel sheet according to (1), the average pole density of the orientation group {100}<011> to {223}<110> may be less than or equal to 2.0 and the pole density of the crystal orientation {332}<113> may be less than or equal to 3.0.

(3) In the hot-rolled steel sheet according to (1), the average grain size may be less than or equal to 7 μm.

(4) The hot-rolled steel sheet according to any one of (1) to (3) may further include, by mass %, Nb: a content [Nb] of 0.005% to 0.06%, in which the contents [Nb], [Ti], [N], [S], and [C] satisfy the following expression (c).

$$0\% \leq [C]-12/48\times([Ti]+[Nb]\times48/93-[N]\times48/14-[S]\times48/32) \quad (c)$$

(5) The hot-rolled steel sheet according to (4) may further include one or two or more selected from the group consisting of, by mass %, Cu: a content [Cu] of 0.02% to 1.2%, Ni: a content [Ni] of 0.01% to 0.6%, Mo: a content [Mo] of 0.01% to 1%, V: a content [V] of 0.01% to 0.2%, Cr: a content [Cr] of 0.01% to 2%, Mg: a content [Mg] of 0.0005% to 0.01%, Ca: a content [Ca] of 0.0005% to 0.01%, REM: a content [REM] of 0.0005% to 0.1%, and B: a content [B] of 0.0002% to 0.002%.

(6) The hot-rolled steel sheet according to any one of (1) to (3) may further include one or two or more selected from the group consisting of, by mass %, Cu: a content [Cu] of 0.02% to 1.2%, Ni: a content [Ni] of 0.01% to 0.6%, Mo: a content [Mo] of 0.01% to 1%, V: a content [V] of 0.01% to 0.2%, Cr: a content [Cr] of 0.01% to 2%, Mg: a content [Mg] of 0.0005% to 0.01%, Ca: a content [Ca] of 0.0005% to 0.01%, REM: a content [REM] of 0.0005% to 0.1%, and B: a content [B] of 0.0002% to 0.002%.

(7) According to another aspect of the present invention, there is provided a method of producing a hot-rolled steel sheet including: heating a steel ingot or a slab including, by mass %, C: a content [C] of 0.02% to 0.07%, Si: a content [Si] of 0.001% to 2.5%, Mn: a content [Mn] of 0.01% to 4%, Al: a content [Al] of 0.001% to 2%, Ti: a content [Ti] of 0.015% to 0.2%, P: a limited content [P] of 0.15% or less, S: a limited content [S] of 0.03% or less, N: a limited content [N] of 0.01% or less, and the balance consisting of Fe and unavoidable impurities, in which the contents [Ti], [N], [S], and [C] satisfy the following expressions (a) and (b), at SRTmin° C., which is the temperature determined according to the following expression (d), to 1260° C.; performing a first hot rolling in which reduction is performed once or more at a rolling reduction of 40% or higher in a temperature range of 1000° C. to 1200° C.; starting second hot rolling in a temperature range of 1000° C. or higher within 150 seconds after the finish of the first hot rolling; performing a reduction in the second hot rolling at least once at a rolling reduction of 30% or higher so as to obtain a total rolling reduction of 50% or higher in a temperature range, when a temperature determined by components of the steel sheet according to the following expression (e) is represented by T1° C., (T1+30)° C. to (T1+200)° C.; performing a third hot rolling in a total rolling reduction is lower than or equal to 30% in which a temperature range of a Ar3 transformation temperature to less than (T1+30)° C.; finishing the hot rollings at the Ar3 transformation temperature or higher; performing a primary cooling under conditions of a cooling rate of 50° C./sec or higher, a temperature change of 40° C. to 140° C., and a cooling end temperature of (T1+100)° C. or lower such that, when a pass of a rolling reduction of 30% or higher in a temperature range of (T1+30)° C. to (T1+200)° C. defined as a large reduction pass, a waiting time t (second) from the finish of a final pass of the large reduction pass to the start of cooling satisfies the following expression (f); performing a secondary cooling at a cooling rate of 15° C./sec or higher within 3 seconds from the finish of the primary cooling; and performing a coiling in a temperature range of 550° C. to lower than 700° C.

$$0\% \leq ([Ti]-[N]\times48/14-[S]\times48/32) \quad (a)$$

$$0\% \leq [C]-12/48\times([Ti]-[N]\times48/14-[S]\times48/32) \quad (b)$$

$$SRTmin=7000/\{2.75-\log([Ti]\times[C])\}-273 \quad (d)$$

$$T1=850+10\times([C]+[N])\times[Mn]+350\times[Nb]+250\times[Ti]+40\times[B]+10\times[Cr]+100\times[Mo]+100\times[V] \quad (e)$$

$$t \leq 2.5\times t1 \quad (f)$$

(wherein t1 is represented by the following expression (g))

$$t1=0.001\times((Tf-T1)\times P1/100)^2-0.109\times((Tf-T1)\times P1/100)+3.1 \quad (g)$$

(wherein Tf represents a temperature (° C.) after a final reduction at a rolling reduction of 30% or higher, and P1 represents the rolling reduction (%) during the final reduction at a rolling reduction of 30% or higher)

(8) In the method of producing a hot-rolled steel sheet according to (7), the primary cooling may be performed between rolling stands and the secondary cooling may be performed after passage through a final rolling stand.

(9) In the method of producing a hot-rolled steel sheet according to (7) or (8), the waiting time t (second) may further satisfy the following expression (h).

$$t1\leq t\leq 2.5\times t1 \quad (h)$$

(10) In the method of producing a hot-rolled steel sheet according to (7) or (8), the waiting time t (second) may further satisfy the following expression (i).

$$t<t1 \quad (i)$$

(11) In the method of producing a hot-rolled steel sheet according to any one of (7) to (10), a temperature increase between passes in the second hot rolling may be lower than or equal to 18° C.

(12) In the method of producing a hot-rolled steel sheet according to any one of (7) to (11), the steel ingot or the slab may further include, by mass %, Nb: a content [Nb] of 0.005% to 0.06%, and the contents [Nb], [Ti], [N], [S], and [C] may satisfy the following expression (c).

$$0\%\leq[C]-12/48\times([Ti]+[Nb]\times48/93-[N]\times48/14-[S]\times48/32) \quad (c)$$

(13) In the method of producing a hot-rolled steel sheet according to (12), the steel ingot or the slab may further include one or two or more selected from the group consisting of, by mass %, Cu: a content [Cu] of 0.02% to 1.2%, Ni: a content [Ni] of 0.01% to 0.6%, Mo: a content [Mo] of 0.01% to 1%, V: a content [V] of 0.01% to 0.2%, Cr: a content [Cr] of 0.01% to 2%, Mg: a content [Mg] of 0.0005% to 0.01%, Ca: a content [Ca] of 0.0005% to 0.01%, REM: a content [REM] of 0.0005% to 0.1%, and B: a content [B] of 0.0002% to 0.002%.

(14) In the method of producing a hot-rolled steel sheet according to any one of (7) to (11), the steel ingot or the slab may further include one or two or more selected from the group consisting of, by mass %, Cu: a content [Cu] of 0.02% to 1.2%, Ni: a content [Ni] of 0.01% to 0.6%, Mo: a content [Mo] of 0.01% to 1%, V: a content [V] of 0.01% to 0.2%, Cr: a content [Cr] of 0.01% to 2%, Mg: a content [Mg] of 0.0005% to 0.01%, Ca: a content [Ca] of 0.0005% to 0.01%, REM: a content [REM] of 0.0005% to 0.1%, and B: a content [B] of 0.0002% to 0.002%.

Advantage of the Invention

According to the above aspects of the present invention, for a steel sheet which can be applied to components (automobile components such as inner plate components, structural components, suspension components, and transmissions; and other components such as shipbuilding materials, construction materials, bridge materials, marine structures, pressure vessels, line pipes, and mechanical components) requiring workability such as hole expansibility or bendability, strict homogeneity in thickness and circularity after processing, and toughness, a high-strength steel sheet having a superior toughness and a tensile strength of 540 MPa grade or higher can be stably produced at a low cost.

EMBODIMENTS OF THE INVENTION

Embodiments of the present invention will be described in detail. Hereinbelow, "mass %" relating to the component composition will be simply referred to as "%".

In order to simultaneously improve isotropy and low-temperature toughness as well as workability, the present inventors have thoroughly investigated a precipitation strengthening type high-strength hot-rolled steel sheet which can be suitably applied to components requiring workability such as hole expansibility, strict homogeneity in thickness and circularity after processing, and toughness at a low temperature. As a result, the following new findings were obtained. "High strength" described in an embodiment of the present invention represents the tensile strength being greater than or equal to 540 MPa.

In order to improve isotropy (to reduce anisotropy), it is effective to avoid the formation of a transformation texture from non-recrystallized austenite, which is the cause of anisotropy. To that end, it is necessary that recrystallization of austenite after finish rolling is promoted. As measures for the promotion, it is effective to optimize a rolling pass schedule and increase a rolling temperature during finish rolling.

Meanwhile, in order to improve toughness, refinement of a fracture surface unit of a brittle fracture surface, that is, refinement of a microstructure unit is effective. To that end, it is effective to increase a nucleation sites which act during γ (austenite)→α (ferrite) transformation. Therefore, it is preferable that a grain boundary and a dislocation density of austenite capable of being the nucleation site are increased.

In order to increase the grain boundary and the dislocation density, it is preferable that rolling is performed at a temperature which is as lower as possible and which is higher than or equal to an γ→α transformation temperature. In other words, it is preferable that austenite is recrystallized to perform γ to α transformation in a state where the austenite is kept as non-crystallized state and a non-recrystallization ratio is high. The reason is that recrystallized austenite grains are rapidly grown at a recrystallization temperature and thus are coarsened within an extremely short period of time; and the coarsened austenite grains are coarse in the α phase after the γ→α transformation.

As described above, with normal hot rolling measures, preferable conditions are contradictory to each other. Therefore, it is considered that the simultaneous improvement of isotropy and toughness is difficult. On the other hand, the present inventors could satisfy a high level of balance between isotropy and toughness and have completed a novel hot rolling method.

The present inventors have obtained the following findings regarding the relationship between isotropy and texture.

Figure 1:
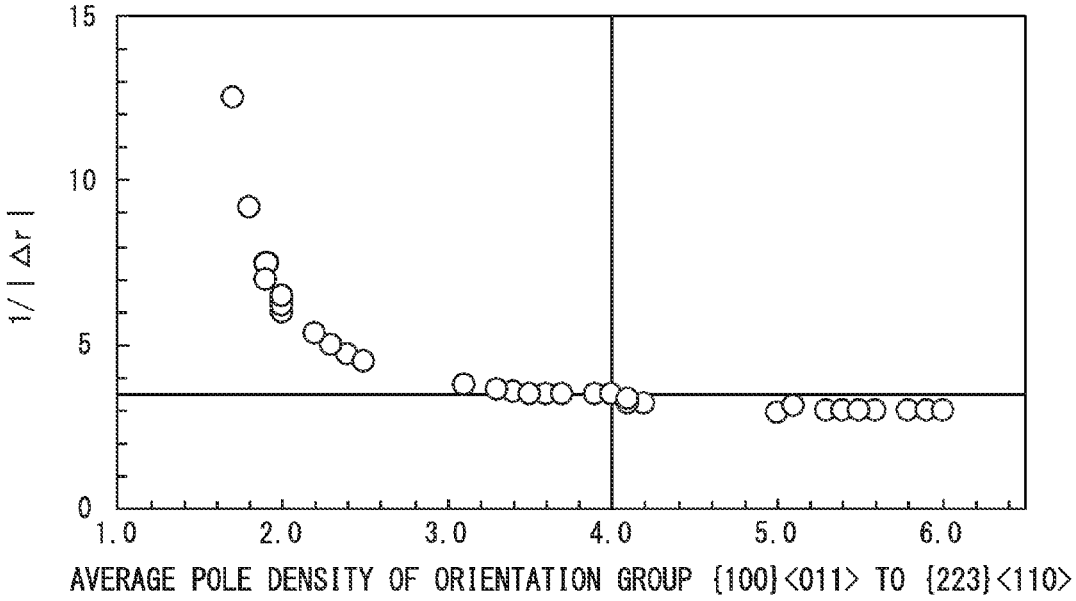
FIG. 1 is a diagram illustrating a relationship between an average pole density of an orientation group {100}<011> to {223}<110> and isotropy (1/|Δr|).

When a steel sheet is processed into a component requiring circularity and homogeneity in thickness in a circumferential direction, in order to obtain circularity and homogeneity which satisfy component properties as processed and without processes of trimming and cutting, it is required that an isotropy index $1/|\Delta r|$ is greater than or equal to 3.5. As illustrated in FIG. 1, in order to control the isotropy index to be greater than or equal to 3.5, in a texture of a steel sheet, it is necessary that an average pole density of an orientation group {100}<011> to {223}<110> in a thickness center portion which is a thickness range of ⅝ to ⅜ from the surface of the steel sheet be 1.0 to 4.0. When this average pole density is greater than 4.0, anisotropy is significantly increased. On the other hand, when the average pole density is less than 1.0, there is a concern about deterioration in hole expansibility due to deterioration in local deformability. In order to obtain a superior isotropy index of 6.0 or greater, it is more preferable that the average pole density of the orientation group {100}<011> to {223}<110> is 2.0 or less. The orientation group {100}<011> to {223}<110> is represented by an arithmetic mean of orientations {100}<011>, {116}<110>, {114}<110>, {112}<110>, and {223}<110>. Therefore, the average pole density of the orientation group {100}<011> to {223}<110> can be obtained by obtaining an arithmetic mean of pole densities of the orientations {100}<011>, {116}<110>, {114}<110>, {112}<110>, and {223}<110>. When the isotropy index is greater than or equal to 6.0, circularity and homogeneity which satisfy component properties can be obtained as processed even in consideration of variation in a coil.

The above-described isotropy index was obtained by processing a steel sheet into a No. 5 test piece according to JIS Z 2201 and performing a test with a test method according to JIS Z 2241. When plastic strain ratios (r values) in a rolling direction, in a direction that forms 45° with respect to the rolling direction, and in a direction (transverse direction) that forms 90° with respect to the rolling direction are defined as r0, r45, and r90, respectively, $\Delta r$ of the isotropy index $1/|\Delta r|$ is defined as $\Delta r=(r0-2\times r45+r90)/2$. $|\Delta r|$ refers to the absolute value of $\Delta r$.

These pole densities of the orientations are measured using an EBSP (Electron Backscattering Diffraction Pattern) method or the like. Specifically, the pole densities are obtained from a three-dimensional texture calculated based on a pole figure {110} according to a vector method; or from a three-dimensional texture calculated using plural pole figures (preferably, three or more) of pole figures {110}, {100}, {211}, and {310} according to a series expanding method.

Figure 2:
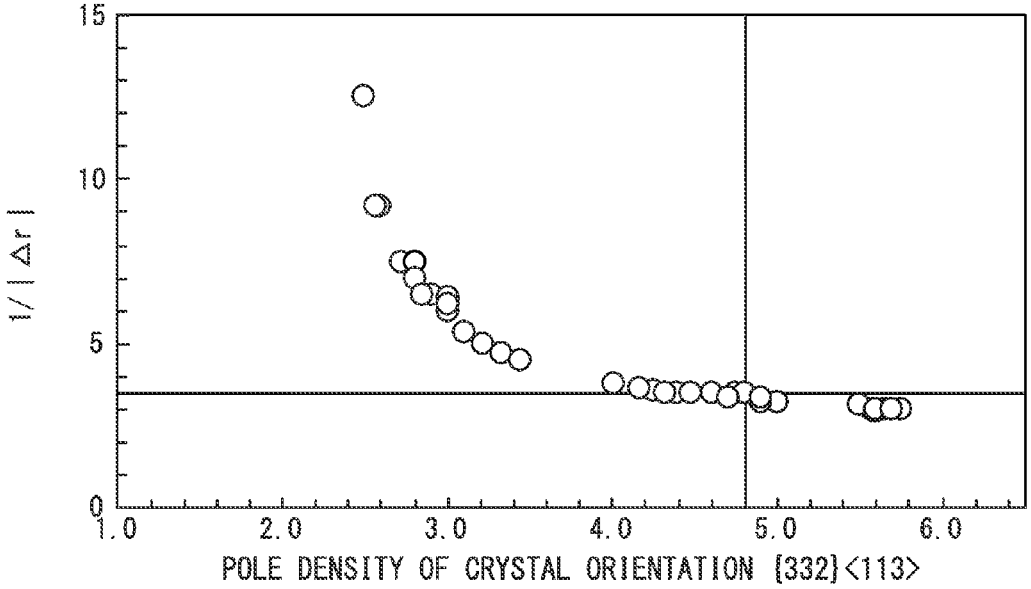
FIG. 2 is a diagram illustrating a relationship between a pole density of a crystal orientation {332}<113> and isotropy (1/|Δr|).

Likewise, as illustrated in FIG. 2, in order to control the isotropy index to be greater than or equal to 3.5, in a texture of a steel sheet, it is necessary that a pole density of a crystal orientation {332}<113> in a thickness center portion which is a thickness range of ⅝ to ⅜ from the surface of the steel sheet is 1.0 to 4.8. When this pole density is greater than 4.8, anisotropy is significantly increased. On the other hand, when the pole density is less than 1.0, there is a concern about deterioration in hole expansibility due to deterioration in local deformability. In order to obtain a superior isotropy index of 6.0 or greater, it is more preferable that the pole density of the crystal orientation {332}<113> is less than or equal to 3.0. When the isotropy index is greater than or equal to 6.0, circularity and homogeneity which satisfy component properties can be obtained as processed even in consideration of variation in a coil.

The above-described average pole density of the orientation group {100}<011> to {223}<110> and the pole density of the crystal orientation {332}<113> have a higher value when a ratio of grains intentionally oriented in a crystal orientation to those oriented in the other orientations is increased.

In addition, the less the pole densities, the higher hole expansibility.

The pole density is synonimous with X-ray random intensity ratio. The X-ray random intensity ratio is the values obtained by measuring the X-ray intensities of a reference sample not having accumulation in a specific orientation and a test sample with an X-ray diffraction method and the like under the same conditions; and dividing the X-ray intensity of the test sample by the X-ray intensity of the reference sample. The pole density can be measured by an X-ray diffraction, EBSP, or ECP (Electron Channeling Pattern) method. For example, the average pole density of the orientation group {100}<011> to {223}<110> is obtained by obtaining pole densities of orientations {100}<011>, {116}<110>, {114}<110>, {112}<110>, and {223}<110> from a three-dimensional texture (ODF) which is calculated using a plurality of pole figures of pole figures {110}, {100}, {211}, and {310} measured by the above-described methods according to a series expanding method; and obtaining an arithmetic mean of these pole densities. In the measurement, a sample which is provided for the X-ray diffraction, EBSP, or ECP method may be prepared in a manner that the thickness of the steel sheet is reduced to a predetermined thickness by mechanical polishing or the like; strain is removed by chemical polishing, electrolytic polishing, or the like; and the sample is adjusted so that an appropriate surface in a thickness range of ⅜ to ⅝ is obtained as the measurement surface. Regarding a transverse direction, it is preferable that the sample is obtained at a ¼ position or a ¾ position from an end portion of the steel sheet.

Of course, when the limitation relating to the above-described pole density is satisfied not only in the thickness center portion but in as many portions having a variety of thicknesses as possible, local deformability is further improved. However, since orientation accumulation in the thickness center portion in a thickness range of ⅜ to ⅝ from the surface of the steel sheet most greatly affects the anisotropy of a product, the material properties of approximately the entire steel sheet can be represented by measuring the thickness center portion which is a thickness range of ⅝ to ⅜ from the surface of the steel sheet. Therefore, the average pole density of the orientation group {100}<011> to {223}<110>; and the pole density of the crystal orientation {332}<113>, in the thickness center portion which is a thickness range of ⅝ to ⅜ from the surface of the steel sheet are defined.

Here, {hkl}<uvw> represents that, when a sample is prepared according to the above-described method, the normal direction of a sheet plane is parallel to {hkl}; and the rolling direction is parallel to <uvw>. Regarding the crystal orientations, generally, orientations perpendicular to a sheet plane are represented by [hkl] or {hkl}; and orientations parallel to the rolling direction are represented by (uvw) or <uvw>. {hkl} and <uvw> represent the collective terms for equivalent planes, and [hkl] and (uvw) represent individual crystal planes. That is, since a body-centered structure is targeted in the embodiment, for example, (111), (−111), (1-11), (11-1), (−1-11), (−11-1), (1-1-1), and (−1-1-1) planes are equivalent and cannot be distinguished from each other. In such a case, these orientations are collectively called {111}. Since ODF is also used for representing orientations of the other low-symmetry crystalline structures, individual orientations are generally represented by [hkl](uvw). However, in the embodiment, [hkl](uvw) and {hkl}<uvw> have the same definition.

Next, the present inventors have investigated about toughness.

As an average grain size is reduced, vTrs is lower, that is, toughness is improved. In a hot-rolled steel sheet according to an embodiment of the present invention, in order to lower vTrs in the thickness center portion than or equal to −20° C., at which the steel plate can be used in a cold region, the average grain size in the thickness center portion is controlled to be less than or equal to 10 μm. Furthermore, when vTrs is controlled to be lower than or equal to −60° C. assuming use in a tough environment, it is more preferable that the average grain size in the thickness center portion is controlled to be less than or equal to 7 μm.

Toughness is evaluated based on vTrs (Charpy fracture appearance transition temperature) obtained in a V-notch Charpy impact test. In the V-notch Charpy impact test, a test piece is prepared according to JIS Z 2202, and the details thereof follow JIS Z 2242.

As described above, toughness is greatly affected by the average grain size in the thickness center portion of a microstructure. The average grain size in the thickness center portion is measured as follows. A micro sample is cut out from the vicinity of the center portion of the steel sheet in a through-thickness direction; and a grain size and a microstructure of the micro sample are measured using EBSP-OIM (registered trademark; Electron BackScatter Diffraction Pattern-Orientation Image Microscopy). The micro sample is prepared by polishing with a colloidal silica abrasive for 30 minutes to 60 minutes and is measured according to EBSP under measurement conditions of a magnification of 400 times, an area of 160 μm×256 μm, and a measurement step of 0.5 μm.

In the EBSP-OIM (registered trademark) method, a highly inclined sample is irradiated with electron beams in a scanning electron microscope (SEM); a Kikuchi pattern formed by backscattering is imaged by a high-sensitive camera; and an image thereof is processed by a computer, thereby measuring a crystal orientation of the irradiation point within a short period of time.

In the EBSP method, a microstructure and a crystal orientation of a bulk sample surface can be quantitatively analyzed. In the EBSP method, an analysis area can be analyzed in a area capable of being observed with a SEM at a resolution of at least 20 nm although the resolution also depends on a resolution of the SEM. The analysis is performed by mapping an analysis area with several tens of thousands of points in a grid shape at regular intervals. In the case of a polycrystalline material, a crystal orientation distribution and a grain size in a sample can be observed.

In the embodiment, among orientation differences of grains, 15°, which is a threshold of a high angle grain boundary generally recognized as a grain boundary, is defined as an orientation difference of a grain boundary for mapping; and grains are visualized based on a mapping image, thereby obtaining the average grain size. That is, "average grain size" refers to the value obtained by EBSP-OIM (registered trademark).

As described above, the present inventors have clarified necessary requirements of a steel sheet for improving isotropy and toughness.

The average grain size, which directly relates to toughness, is refined as a finish rolling end temperature is reduced. However, as controlling factors of isotropy, the average pole density of the orientation group {100}<011> to {223}<110>, which is represented by an arithmetic mean of pole densities of the orientations {100}<011>, {116}<110>, {114}<110>, {112}<110>, and {223}<110>; and the pole density of the crystal orientation {332}<113>, in the thickness center portion which is a thickness range of ⅝ to ⅜ from the surface of the steel sheet have the opposite relationship to the average grain size with respect to the finish rolling temperature. Therefore, techniques of simultaneously improving both isotropy and low-temperature toughness have not yet to be disclosed.

In order to secure isotropy, the present inventors have investigated a hot rolling method and conditions for simultaneously improving isotropy and toughness by sufficiently recrystallizing austenite after finish rolling and by suppressing the growth of recrystallized grains to the minimum.

In order to recrystallize austenite grains having a deformation texture due to rolling, it is preferable that finish rolling is performed in an optimum temperature range and at a total rolling reduction of 50% or higher. On the other hand, in order to refine a microstructure of a final product, it is preferable that cooling start within a predetermined time after the finish of finish rolling to suppress the growth of recrystallized austenite grains to the minimum.

Therefore, when a temperature represented by the above-described expression (e) is represented by T1, hot rolling is performed at a total rolling reduction R in a temperature range of (T1+30)° C. to (T1+200)° C. Then, it is investigated how each of the average pole density of the orientation group {100}<011> to {223}<110> in the thickness center portion which is a thickness range of ⅝ to ⅜ from the surface of the steel sheet; and the average grain size in the thickness center portion are changed depending on a relationship between a waiting time t from the finish of the hot rolling to the start of cooling and a cooling temperature change, in case that the cooling is performed under conditions of a cooling rate of 50° C./sec or higher, a temperature change of 40° C. to 140° C., and a cooling end temperature of (T1+100)° C. or lower. R is higher than or equal to 50%. The total rolling reduction (sum of rolling reductions) described in the embodiment has the same definition as a so-called cumulative rolling reduction; and refers to the percentage of, in the above-described rolling of each temperature range, a cumulative rolling amount (a difference between an entry-side thickness before an initial pass and an exit-side thickness after a final pass in the above-described rolling of each temperature range) to an entry-side thickness before an initial pass.

As a result, when the waiting time t from the finish of the hot rolling, which is performed at the total rolling reduction R in the temperature range of (T1+30)° C. to (T1+200)° C., to the start of the cooling, which is performed under conditions of a cooling rate of 50° C./sec or higher, a temperature change of 40° C. to 140° C., and a cooling end temperature of (T1+100)° C. or lower, is within t1×2.5 seconds expressed by the expression (g). The average pole density of the orientation group {100}<011> to {223}<110> and the pole density of the crystal orientation {332}<113> is 1.0 to 4.8; in the thickness center portion which is a thickness range of ⅝ to ⅜ from the surface of the steel sheet is 1.0 to 4.0, and the average grain size in the thickness center portion is less than or equal to 10 μm. That is, it is assumed that isotropy and impact resistance, which are the object of the embodiment, are satisfied.

The above-described results show that a range capable of improving both isotropy and toughness, that is, a range of simultaneously realizing sufficient recrystallization and refinement of austenite can be achieved with a hot rolling method according to an embodiment of the present invention which will be described below in detail.

Furthermore, it was found that, when the average grain size is less than or equal to 7 μm, the waiting time t is preferably shorter than t1. In addition, it was found that, when the average pole density of the orientation group {100}<011> to {223}<110> is less than or equal to 2.0, the waiting time t is preferably longer than or equal to t1.

Based on the findings obtained by the above-described fundamental investigation, the present inventors have further thoroughly investigated a precipitation strengthening type high-strength hot-rolled steel sheet which can be suitably applied to components requiring workability such as hole expansibility, strict homogeneity in thickness and circularity after processing, and toughness at a low temperature. As a result, the present inventors conceived a hot-rolled steel sheet which satisfies the following conditions; and a method of producing the same.

The reason for limiting chemical compositions of the hot-rolled steel sheet according to the embodiment will be described.

C: a content [C] of 0.02% to 0.07%

C segregates on a grain boundary and suppresses fracture surface cracking at an end surface which is formed by shearing and punching. In addition, C is bonded to Nb, Ti, or the like to form a precipitation, and contributes to strength improvement by precipitation strengthening. In addition, C produces iron carbides such as cementite ($Fe_3C$) which cause cracking during hole expansion.

When the content [C] of C is less than 0.02%, the strength improvement by precipitation strengthening and the effect of suppressing fracture surface cracking cannot be obtained. On the other hand, when the content [C] of C is greater than 0.07%, iron carbides such as cementite ($Fe_3C$) which cause cracking during hole expansion are increased and thus, a hole expansion value and toughness deteriorate. Therefore, the content [C] of C is set to 0.02% to 0.07%. In consideration of strength improvement and ductility improvement, the content [C] is preferably 0.03% to 0.05%.

Si: a content [Si] of 0.001% to 2.5%

Si contributes to an increase in the strength of a base metal. In addition, Si also functions as a deoxidizing agent. When 0.001% or greater of Si is added, the addition effects can be exhibited, and when the addition amount is greater than 2.5%, the effect of increasing the strength is saturated. Therefore, the content [Si] of Si is set to 0.001% to 2.5%.

From the viewpoints of strength improvement and hole expansibility, when the content [Si] of Si is greater than 0.1%, the precipitation of iron carbides such as cementite in a material structure is suppressed; and the precipitation of fine carbonate precipitates of Nb or Ti is promoted, and contributes to strength improvement and hole expansibility. On the other hand, when the content [Si] of Si is greater than 1%, the effect of suppressing the precipitation of iron carbides is saturated. Therefore, a preferable range of the content [Si] of Si is greater than 0.1% and less than or equal to 1%.

Mn: a content [Mn] of 0.01% to 4%

Mn contributes to strength improvement by solid solution strengthening and hardening strengthening. However, when the content [Mn] of Mn is less than 0.01%, the addition effects cannot be obtained. On the other hand, when the content [Mn] of Mn is greater than 4%, the addition effects are saturated. Therefore, the content [Mn] of Mn is set to 0.01% to 4%. When elements other than Mn are not sufficiently added in order to suppress hot rolling cracking caused by S, it is preferable that Mn (mass %) is added such that the content [Mn] of Mn and the content [S] of S satisfy an expression of [Mn]/[S]≥20.

Along with an increase in content, Mn widens an austenite region temperature to a low temperature side, improves hardenability, and promotes the formation of a continuous cooling transformation structure which is superior in burring (burring workability). Since this effect is difficult to obtain with the addition of 1% or less of Mn, it is preferable that 1% or greater of Mn is added. On the other hand, when greater than 3.0% of Mn is added, the austenite region temperature is excessively lowered and thus, it is difficult to produce carbides of Nb or Ti which finely precipitate during ferrite transformation. Accordingly, when a continuous cooling transformation structure is formed, it is preferable that the content [Mn] of Mn is set to 1.0% to 3.0%. It is more preferable that the content [Mn] of Mn is set to 1.0% to 2.5%.

P: a content [P] of greater than 0% and 0.15% or less

P is an impurity incorporated into molten iron, segregates on a grain boundary, and reduces toughness along with an increase in content. Therefore, it is preferable that the content [P] of P is less. When the content [P] of P is greater than 0.15%, there are adverse effects on workability and weldability. Therefore, the content [P] of P is limited to be less than or equal to 0.15%. In particular, the [P] of P is preferable less than or equal to 0.02% in consideration of hole expansibility and weldability. Since it is difficult that the content of P becomes 0% because of operational problems, the content [P] of P does not include 0%.

S: a content [S] of greater than 0% and 0.03% or less

S is an impurity incorporated into molten iron, and causes cracking during hot rolling and produces A type inclusions impairing hole expansibility. Therefore, it is preferable that S be reduced to the minimum. However, since a content [S] of S of 0.03% or less is in an allowable range, the content [S] of S is limited to be less than or equal to 0.03%. When higher hole expansibility is necessary, the content [S] of S is preferably less than or equal to 0.01% and more preferably less than or equal to 0.005%. Since it is difficult that the content of S becomes 0% because of operational problems, the content [S] of S does not include 0%.

N: a content [N] of greater than 0% and 0.01% or less

N forms a precipitate with Ti and Nb, and fixes C and reduces Ti and Nb effective for precipitation strengthening. As a result, a tensile strength is reduced. Therefore, it is preferable that N is reduced to the minimum, but a content [N] of S of 0.01% or less is in an allowable range. However, nitrides of Ti or Nb which precipitate at a high temperature are easily coarsened, causes brittle fracture, and reduces low-temperature toughness. Therefore, in order to further improve toughness, the content [N] is preferably less than or equal to 0.006%. From the viewpoint of aging resistance, the content [N] is more preferably less than or equal to 0.005%. Since it is difficult that the content of N becomes 0% because of operational problems, the content [N] of S does not include 0%.

Al: a content [Al] of 0.001% to 2%

0.001% or greater of Al is added for molten steel deoxidation in a refining process of steel. However, a large amount of addition causes an increase in cost, the upper limit is set to 2%. When a large amount of Al is added, the amount of non-metal inclusions increases and ductility and toughness deteriorate. Therefore, from the viewpoints of ductility and toughness, the content [Al] is preferably less than or equal to 0.06%. The content [Al] is more preferably less than or equal to 0.04%.

Like Si, Al suppresses the precipitation of iron carbides such as cementite in a structure. In order to obtain this effect, it is preferable that 0.016% or greater of Al is added. Therefore, a content [Al] of Al is more preferably 0.016% to 0.04%.

Ti: a content [Ti] of 0.015% to 0.2%

Ti is one of the most important elements in the embodiment. During cooling after the finish of rolling, or during $\gamma \rightarrow \alpha$ transformation after coiling, Ti precipitates finely and improves the strength by precipitation strengthening. In addition, Ti fixes C as a carbide to form TiC and thus suppresses the formation of cementite which is disadvantageous for burring workability.

Furthermore, Ti precipitates as TiS when a billet is heated during a hot rolling process, suppresses the precipitation of MnS which forms a drawn inclusion, and reduces a total sum M of length of inclusion in a rolling direction. In order to obtain these addition effects, it is necessary that at least 0.015% of Ti is added. It is preferable that 0.1% or greater of Ti be added.

On the other hand, when greater than 0.2% of Ti is added, the addition effects are saturated, the effect of suppressing recrystallization is excessively exhibited, and thus isotropy deteriorates. Therefore, the content [Ti] of Ti is set to 0.015% to 0.2%. The content [Ti] is more preferably 0.1% to 0.16%.

$$0\% \leq [Ti]-[N]\times 48/14-[S]\times 48/32 \quad (a)$$

S and N form precipitates such as TiN or TiS with Ti in a higher temperature range than that of C. Therefore, in order to fix C, which is the base element of carbides such as cementite impairing hole expansibility, and to secure TiC contributing to precipitation strengthening, a relationship between the content [S] of S, a content [N] of N and the content [Ti] of Ti satisfies the expression (a).

$$0\% \leq [C]-12/48\times([Ti]-[N]\times 48/14-[S]\times 48/32) \quad (b)$$

In the expression (b), [C], [Ti], [N], and [S] represent the content of C, the content of Ti, the content of N, and the content of S, respectively. When the hot-rolled steel sheet according to the embodiment does not contain Nb, the right side of the expression (b) is the expression expressing the C content which can remain as a solid-soluted C after the precipitation of TiC. The right side of the expression (b) being less than or equal to 0% represents the solid-soluted C being not present in a grain boundary. When the solid-soluted C is not present, an intergranular strength deteriorates relative to an intragranular strength and thus, fracture surface cracking occurs. Therefore, the right side of the expression (b) is set to be greater than 0%.

The upper limit of the expression (b) is not particularly limited, but is preferably less than or equal to 0.045% so as to make an appropriate amount of C remain and to control a cementite grain size to be less than or equal to 2 μm. When the cementite grain size is less than or equal to 1.6 μm, the upper limit of the expression (b) is more preferably less than or equal to 0.012%. On the other hand, when the upper limit of the expression (b) is greater than 0.045%, the cementite grain size increases and thus, there is a concern about deterioration in hole expansibility. Therefore, the upper limit of the expression (b) is preferably less than or equal to 0.045%.

The above-described chemical elements are base components (base elements) of the steel according to the embodiment. A chemical composition in which the base components are controlled (contained or limited); and a balance thereof is iron and unavoidable impurities, is a basic composition according to the embodiment. However, in addition to this basic composition (instead of a part of Fe of the balance), the steel according to the embodiment may optionally further contain the following chemical elements (optional elements). Even when these optional elements are unavoidably (for example, the content of each optional element is less than the lower limit) incorporated into the steel, the effects of the embodiment do not deteriorate.

Nb: a content [Nb] of 0.005% to 0.06%

During cooling after the finish of rolling, or after coiling, Nb precipitates finely and improves the strength by precipitation strengthening. In addition, Nb fixes C as a carbide and thus suppresses the formation of cementite which is disadvantageous for burring workability.

Furthermore, Nb has a function of reducing the average grain size of the steel sheet and contributes to the improvement in low-temperature toughness. In order to obtain these addition effects, it is necessary that the content [Nb] of Nb is greater than or equal to 0.005%. It is preferable that the content [Nb] of Nb is greater than 0.01%. By setting the lower limit of the content [Nb] of Nb to 0.005%, the grain size can be reduced. As a result, there are no adverse effects on low-temperature toughness and the degree of freedom in rolling temperature setting can be improved.

On the other hand, when the content [Nb] of Nb is greater than 0.06%, a temperature range of a non-recrystallization region during a hot rolling process is widened, a large amount of rolling texture in the non-recrystallized state remains after the finish of hot rolling, and thus isotropy deteriorates. Therefore, the content [Nb] of Nb is set to 0.005% to 0.06%. The content [Nb] of Nb is preferably 0.01% to 0.02%.

$$0\% \leq [C]-12/48\times([Ti]+[Nb]\times 48/93-[N]\times 48/14-[S]\times 48/32) \quad (c)$$

When the hot-rolled steel sheet according to the embodiment contains Nb, it is necessary that [C], [Ti], [Nb] (content of Nb), [N], and [S] satisfy the expression (c) instead of the expression (b). In the expression (c), an expression of [Nb]×48/93 is added into the parentheses of the expression (b). The technical implication of the expression (c) is the same as that of the expression (b).

Optionally, the hot-rolled steel sheet according to the embodiment may further contain one or two or more selected from the group consisting of Cu, Ni, Mo, V, Cr, Mg, Ca, REM (Rare Earth metal), and B.

Hereinbelow, the reason for limiting the composition of each element will be described.

Cu, Ni, Mo, V, and Cr are elements which improve the strength of the hot-rolled steel sheet by precipitation strengthening or solid solution strengthening.

When a content [Cu] of Cu is less than 0.02%; a content [Ni] of Ni is less than 0.01%; a content [Mo] of Mo is less than 0.01%; a content [V] of V is less than 0.01%; or a content [Cr] of Cr is less than 0.01%, the addition effect cannot be sufficiently obtained. On the other hand, when the content [Cu] of Cu is greater than 1.2%; the content [Ni] of Ni is greater than 0.6%; the content [Mo] of Mo is greater than 1%; the content [V] of V is greater than 0.2%; or the content [Cr] of Cr is greater than 2%, the addition effect is saturated and the economic efficiency deteriorates.

Therefore, when one or two or more selected from the group consisting of Cu, Ni, Mo, V, and Cr are added, it is preferable that the content [Cu] of Cu is 0.02% to 1.2%; the content [Ni] of Ni is 0.01% to 0.6%; the content [Mo] of Mo is 0.01% to 1%; the content [V] of V is 0.01% to 0.2%; and the content [Cr] of Cr is 0.01% to 2%.

Mg, Ca, and REM (Rare Earth Metal) controls non-metal inclusions, which are origin of the fracture and deteriorates workability, and improves workability. When a content [Mg] of Mg, a content [Ca] of Ca, or a content [REM] of REM is less than 0.0005%, the addition effect is not obtained. On the other hand, when the content [Mg] of Mg is greater than 0.01%, the content [Ca] of Ca is greater than 0.01%, or the content [REM] of REM is greater than 0.1%, the addition effect is saturated and the economic efficiency deteriorates. Therefore, it is preferable that the content [Mg] of Mg be 0.0005% to 0.01%; the content [Ca] of Ca be 0.0005% to 0.01%; and the content [REM] of REM be 0.0005% to 0.1%.

B: a content [B] of 0.0002% to 0.002%

Like C, B segregates on a grain boundary and is effective for increasing intergranular strength. That is, in addition to the solid-soluted C, the solid-soluted B segregates on a grain boundary and effectively acts for preventing fracture surface cracking. Even when C precipitates in grains as TiC, B can compensate for a reduction of C in a grain boundary by segregating the grain boundary.

In order to compensate for the reduction of C in a grain boundary, it is necessary that at least 0.0002% of B be added. 0.0002% or greater of B and the solid-soluted C serve to prevent fracture surface cracking. When the content [B] of B is greater than 0.002%, like Nb, there is a concern that the recrystallization of austenite during hot rolling may be suppressed; the formation of a $\gamma \rightarrow \alpha$ transformation texture from non-recrystallized austenite may be promoted; and isotropy may deteriorate. Therefore, the content [B] of B is set to 0.0002% to 0.002%.

In addition, B improves hardenability and promotes the formation of a continuous cooling transformation structure as a microstructure which is preferable for burring workability. In order to obtain the effect, the content [B] of B is preferably greater than or equal to 0.001%. On the other hand, in a cooling process after continuous casting, B causes slab cracking. From the point of view of the above, the content [B] of B is preferably less than or equal to 0.0015%. The content [B] of B is preferably 0.001% to 0.0015%.

The hot-rolled steel sheet according to the embodiment may further contain one or two or more, for a total content of 1% or less, selected from the group consisting of Zr, Sn, Co, Zn, and W within a range not impairing properties as unavoidable impurities. However, since there is a concern about defects during hot rolling, a content of Sn is preferably less than or equal to 0.05%.

Next, metallurgical factors relating to a microstructure and the like of the hot-rolled steel sheet according to the embodiment will be described.

Grain-boundary cementite which affects hole expansibility will be described. Hole expansibility is affected by voids which cause cracking during punching or shearing. Voids are formed when a cementite phase, which precipitates in a parent-phase grain boundary, has a given level of grain size relative to parent-phase grains; and an excess amount of stress concentrates on parent-phase grains in the vicinity of grain boundaries.

When the cementite grain size is less than or equal to 2 μm, cementite grains are small relative to parent-phase grains and, dynamically, stress concentration does not occur. Therefore, the formation of voids is difficult. As a result, hole expansibility and toughness are improved. Therefore, a grain-boundary cementite grain size (average grain size of cementite precipitating in a grain boundary) is controlled to be less than or equal to 2 μm. The grain-boundary cementite grain size is preferably less than or equal to 1.6 μm.

In the embodiment, the average grain size of the grain-boundary cementite precipitating in a grain boundary is obtained by preparing a transmission electron microscope sample at a ¼-thick portion of a sample which is cut out from a ¼-width or ¾-width position of a sample steel; and observing the transmission electron microscope sample with a transmission electron microscope on which a field emission gun (FEG) having an accelerating voltage of 200 kV is mounted. By analyzing a diffraction pattern, it is confirmed that a precipitate observed in the grain boundary is cementite. In this investigation, the grain-boundary cementite grain size is defined as the average value of measured values obtained by measuring all the grain sizes of grain-boundary cementite observed in a single visual field.

In general, the grain-boundary cementite grain size increases as a coiling temperature of the steel sheet increases. However, when the coiling temperature is higher than or equal to a predetermined temperature, there is a tendency that the grain-boundary cementite grain size becomes rapidly smaller. In particular, in a steel sheet containing at least one of Ti and Nb, the reduction of the grain-boundary cementite grain size is significant in the temperature range. In order to control the grain-boundary cementite grain size to be less than or equal to 2 μm, it is necessary that the coiling temperature be higher than or equal to 550° C. The reason why the cementite grain size is reduced by an increase in coiling temperature is considered to be as follows.

A precipitation temperature of cementite in the α phase (ferrite phase) has a nose region. The nose region can be explained as a balance between the nucleation which uses supersaturation of C in the α phase as a driving force and the grain growth of $Fe_3C$ in which a rate is controlled by diffusion of C and Fe.

When the coiling temperature is lower than a temperature of the nose region, the supersaturation of C is great and the driving force of the nucleation is high. However, since the coiling temperature is low, diffusion is almost not performed. Therefore, the precipitation of cementite is suppressed both in grain boundaries and in grains. In addition, even if cementite precipitates, the grain size thereof is small.

On the other hand, when the coiling temperature is higher than the temperature of the nose region, the solubility of C is increased and the driving force of the nucleation is reduced. However, a diffusion length is long. Therefore, the density is reduced, but the grain size of cementite is increased.

When a carbide-forming element such as Ti or Nb is contained, a precipitation nose region of Ti or Nb in the α phase is present on a higher temperature side than that of a precipitation nose region of cementite. Therefore, C is lost by the precipitation of carbides such as Ti or Nb and both the precipitation amount and grain size of cementite are reduced.

Next, precipitation strengthening will be described. In the embodiment, Ti is mainly used as a precipitation strengthening element. The present inventors investigated a steel containing Ti about a relationship between the average grain size and density of precipitates (hereinbelow, referred to as "TiC precipitates") containing TiC and a tensile strength.

The grain size and density of the TiC precipitates are measured using a three-dimensional atom probe method. An acicular sample is prepared from a sample of a measurement target by cutting and electropolishing and, optionally, by a combination of electropolishing and focused ion-beam milling. In the three-dimensional atom probe measurement, cumulative data can be reconstructed to obtain an actual distribution image of atoms in a real space. That is, a number density of the TiC precipitates is obtained from the volume of the three-dimensional distribution image of the TiC precipitates and the number of TiC precipitates.

The grain size of the TiC precipitates can be obtained by calculating a diameter from the number of atoms constituting the observed TiC precipitates and a lattice constant of TiC, assuming that the shape of the precipitates is spherical. Arbitrarily, diameters of 30 or more TiC precipitates are measured and the average value thereof is obtained.

A sample is processed into a No. 5 test piece according to JIS Z 2201 and a tensile test for a hot-rolled steel sheet is performed according to JIS Z 2241.

If the chemical composition is constant, the average grain size and the density of the precipitates containing TiC have an almost inverse relationship with each other. In order to obtain a increase in tensile strength of 100 MPa by precipitation strengthening, it is necessary for the average grain size of the precipitates containing TiC to be smaller than or equal to 3 nm; and the density thereof be greater than or equal to $1\times10^{16}$ grains/cm$^3$. When the precipitates containing TiC are coarse, toughness may deteriorate or fracture surface cracking is likely to occur.

A microstructure of a parent-phase of the hot-rolled steel sheet according to the embodiment is not particularly limited. However, when the tensile strength is greater than or equal to 780 MPa grade, a continuous cooling transformation structure (Zw) is preferable. Even in this case, the microstructure of the parent-phase of the hot-rolled steel sheet may contain polygonal ferrite (PF) having a volume fraction of 20% or lower in order to simultaneously improve both workability and ductility represented by uniform elongation. Incidentally, the volume fraction of the microstructure refers to the area fraction in a measurement visual field.

The continuous cooling transformation structure (Zw) described in the embodiment refers to, as disclosed in "Recent Study relating to Bainite structure and Transformation Action of Low-Carbon Steel—the Final Report of Bainite Research Committee—" (Bainite Research Committee, Society of Basic Research, The Iron and Steel Institute of Japan; 1994), a microstructure defined as a transformation structure in the intermediate state between a microstructure containing polygonal ferrite and pearlite produced by a diffusion mechanism; and martensite produced by a shearing mechanism without diffusion.

That is, as described as an optical microscopic structure in pp. 125 to 127 of the above-described reference document, the continuous cooling transformation structure (Zw) is defined as a microstructure which mainly contains Bainitic Ferrite ($\alpha^\circ$ B), Granular bainitic Ferrite ($\alpha$B), and Quasi-polygonal Ferrite ($\alpha$q) and may further contain a small amount of retained austenite ($\gamma$r) and Martensite-Austenite (MA).

Like polygonal ferrite (PF), an internal structure of $\alpha$q does not appear by etching, but the shape thereof is acicular. Therefore, $\alpha$q is clearly distinguished from PF. $\alpha$q refers to a grain in which, when the peripheral length of a target grain is represented by lq and the equivalent circle diameter thereof is represented by dq, the ratio (lq/dq) thereof satisfies an expression of $lq/dq\geq3.5$.

The continuous cooling transformation structure (Zw) of the hot-rolled steel sheet according to the embodiment is defined as a microstructure containing one or two or more selected from $\alpha^\circ$ B, $\alpha$B, $\alpha$q, $\gamma$r, and MA. A total amount of $\gamma$r and/or MA is less than or equal to 3%.

The structure can be determined by etching using a nital reagent and observation using an optical microscope. However, there is a case where the continuous cooling transformation structure (Zw) may be difficult to determine by etching using a nital reagent and observation using an optical microscope. In this case, EBSP-OIM (registered trademark) is used for determination. For example, ferrite, bainite, and martensite which have a bcc structure can be identified using a KAM (Kernel Average Misorientation) method equipped with EBSP-OIM (registered trademark). In the KAM method, a calculation is performed for each pixel in which orientation differences between pixels are averaged using, among measurement data, a first approximation of six adjacent pixels of pixels of a regular hexagon, a second approximation of 12 pixels thereof which is further outside, or a third approximation of 18 pixels thereof which is further outside; and the average value is set to a center pixel value. By performing this calculation so as not to exceed a grain boundary, a map representing orientation changes in grains can be created. This map shows the strain distribution based on local orientation changes in grains.

Furthermore, a condition for calculating orientation differences between adjacent pixels in EBSP-OIM (registered trademark) is set to the third approximation and these orientation differences are set to be less than or equal to 5°. In the above-described third approximation of orientation differences, when the calculated value is greater than 1°, the pixel is defined as the continuous cooling transformation structure (Zw); and when the calculated value is less than or equal to 1°, the pixel is defined as ferrite. The reason is as follows: since polygonal pro-eutecitoid ferrite transformed at a high temperature is produced by diffusion transformation, a dislocation density is low, a strain in grains is small, and differences between crystal orientations in grains are small; and as a result of various investigations which have been performed by the present inventors, it was found that the ferrite volume fraction obtained by observation using an optical microscope approximately matched with the area fraction obtained by the third approximation of orientation differences of 1° in the KAM method.

In the EBSP-OIM (registered trademark) method, a highly inclined sample is irradiated with electron beams in a scanning electron microscope (SEM); and a Kikuchi pattern formed by backscattering is imaged by a high-sensitive camera. Then, an image thereof is processed by a computer, and thereby a crystal orientation of the irradiation point can be measured within a short period of time.

In the EBSP method, a microstructure and a crystal orientation of a bulk sample surface can be quantitatively analyzed. An analysis area can be analyzed in an area capable of being observed with a SEM at a resolution of at least 20 nm although the resolution also depends on the resolution of the SEM.

The analysis using the EBSP-OIM (registered trademark) method is performed by mapping an analysis area with several tens of thousands of points in a grid shape at regular intervals. In the case of a polycrystalline material, a crystal orientation distribution and a grain size in a sample can be observed. In the hot-rolled steel sheet according to the embodiment, an orientation difference of each packet is set to 15° for mapping; and a structure which can be determined based on a mapping image may be defined as the continuous cooling transformation structure (Zw) for convenience.

Next, the reason for limiting conditions for a method of producing a hot-rolled steel sheet according to an embodiment of the present invention (hereinbelow, referred to as "production method according to the embodiment") will be described.

In the production method according to the embodiment, a method of producing a steel piece which is performed before a hot rolling process is not particularly limited. That is, in the method of producing a steel piece, a process of preparing an ingot is performed using a blast furnace, a converter furnace, an electric furnace, or the like; various kinds of secondary smelting processes may be performed to adjust components and thus to obtain the desired chemical composition; and a casting process may be performed with a method such as normal continuous casting, ingot casting, or thin slab casting.

When a slab is obtained by continuous casting, the high-temperature slab may be directly fed into a hot rolling mill; or may be cooled to room temperature once and heated again in a heating furnace for hot rolling. As a raw material, scrap may be used.

The slab obtained according to the above-described production method is heated in a slab heating process before the hot rolling process. At this time, heating is performed in a heating furnace at a temperature higher than or equal to a minimum slab reheating temperature SRTmin° C. calculated according to the following expression (d).

$$SRTmin=7000/\{2.75-\log([Ti]\times[C])\}-273 \quad (d)$$

the expression (d) is the expression to obtain the solution temperature of a carbonitride of Ti from a product of the content [Ti] (%) of Ti and the content [C] (%) of C. Conditions for obtaining a composite precipitate of TiNbCN are determined according to the content of Ti. That is, when the content of Ti is small, TiN alone does not precipitate.

When the slab heating temperature is higher than or equal to the temperature SRTmin° C. which satisfies the expression (d), the tensile strength of the steel sheet is significantly improved. The reason is considered to be as follows.

In order to obtain the desired tensile strength, it is effective to use precipitation strengthening with Ti and/or Nb. In a slab before heating, coarse carbonitrides such as TiN, NbC, TiC, and NbTi (CN) precipitate. In order to effectively obtain the effect of precipitation strengthening with Nb and/or Ti, it is necessary that these coarse carbonitrides are temporarily and sufficiently dissolved in a base metal during the slab heating process.

Most of carbonitrides of Nb and/or Ti are dissolved at a solution temperature of Ti. The present inventors found that, in order to obtain the desired tensile strength, it is necessary that a slab is heated to the solution temperature SRTmin° C. of Ti in the slab heating process.

TiN, TiC, and NbN—NbC have literature values for solubility product. In particular, since TiN precipitates at a high temperature, it is assumed that TiN is difficult to dissolve by low-temperature heating according to the embodiment. However, the present inventors found that, although TiN was not completely dissolved, most of TiC was substantially dissolved with only the solutionizing of thereof.

When a precipitate, which is considered to be a composite precipitate of TiNb(CN), is observed through replica observation of a transmission electron microscope, concentrations of Ti, Nb, C, and N are changed in a center portion in which precipitation occurs at a high temperature and a shell portion in which precipitation occurs at a relatively low temperature. That is, the concentrations of Ti and N are high in the center portion, whereas the concentrations of Nb and C are high in the shell portion.

The reason is as follows: TiNb(CN) is a MC type precipitate having a NaCl structure, and in TiC, Ti is coordinated to an M site and C is coordinated to a C site; however, depending on temperatures, Ti may be substituted with Nb and C may be substituted with N.

The same shall be applied to TiN. Even at a temperature at which TiC is completely dissolved, TiN contains Ti at a site fraction of 10% to 30%. Therefore, technically, TiN is completely dissolved at a temperature which is higher than or equal to a temperature at which TiN is completely dissolved. However, in a component system having a relatively small amount of Ti, substantially, the solution temperature may be set to the lower limit of the dissolution temperature of TiC precipitates.

When the heating temperature is lower than SRTmin° C., carbonitrides of Nb and/or Ti are not sufficiently dissolved in a base metal. In this case, during cooling after the finish of rolling, or after coiling, precipitation strengthening in which the effect of increasing strength is obtained by Nb and/or Ti finely precipitating as carbides cannot be used. Therefore, the heating temperature in the slab heating process is set to be higher than or equal to SRTmin° C. calculated according to the expression (d).

When the heating temperature in the slab heating process is higher than 1260°, yield deteriorates due to scale-off. Therefore, the heating temperature is set to be lower than or equal to 1260° C. Therefore, the heating temperature in the slab heating process is set to the minimum slab reheating temperature SRTmin° C., calculated according to the expression (d), to 1260° C. When the heating temperature is lower than 1150° C., the operation efficiency significantly deteriorates due to schedule problems. Therefore, the heating temperature is preferably higher than or equal to 1150° C.

The heating time in the slab heating process is not particularly limited. However, in order to sufficiently progress the dissolution of carbonitrides of Nb and/or Ti, it is preferable heating is continued for 30 minutes or longer after the heating temperature is reached. However, a case where a slab after casting is directly fed for rolling at a high temperature is not limited thereto.

A rough rolling process of performing rough rolling (first hot rolling) on a slab, which is extracted from a heating furnace within a short time (for example, within 5 minutes, preferably, within 1 minute) after the slab heating process, starts to obtain a rough bar.

Rough rolling (first hot rolling) finishes at a temperature of 1000° C. to 1200° C. When the rough rolling end temperature is lower than 1000° C., a hot deformation resistance is increased during rough rolling, which brings about operational problems during rough rolling.

When the rough rolling end temperature is higher than 1200° C., the average grain size is increases, which causes deterioration in toughness. Furthermore, since secondary scales produced during rough rolling are excessively grown, there may be problems during descaling which is subsequently performed or during scale removal in finish rolling. When the rough rolling end temperature is higher than 1150° C., inclusion are drawn, which may cause deterioration in hole expansibility. Therefore, the rough rolling end temperature is preferably lower than or equal to 1150° C.

When a rolling reduction of rough rolling is low, the average grain size is large and toughness deteriorates. When the rolling reduction is higher than or equal to 40%, the grain size is uniform and small. On the other hand, when the rolling reduction is higher than 65%, inclusion are drawn, which may cause deterioration in hole expansibility. Therefore, the rolling reduction is preferably lower than or equal to 65%.

In order to refine the average grain size of the hot-rolled steel sheet, an austenite grain size after rough rolling, that is, before finish rolling (second hot rolling) is important. It is preferable that the austenite grain size before finish rolling is smaller. From the viewpoint of grain refining and homogenizing, the austenite grain size is preferably less than or equal to 200 μm. To obtain the austenite grain size which is less than or equal to 200 μm, rolling is performed at least once at a rolling reduction of 40% or higher during rough rolling (first hot rolling).

In order to more efficiently obtain the effects of grain refining and homogenizing, the austenite grain size is more preferably less than or equal to 100 μm. To that end, it is more preferable that rolling be performed 2 or more times at a rolling reduction of 40% or higher during rough rolling (first hot rolling). However, when rough rolling is performed more than 10 times, there are concerns about a reduction in temperature and excessive production of scale.

As described above, a reduction in austenite grain size before finish rolling is effective for promoting the recrystallization of austenite during subsequent finish rolling.

The reason is considered to be that an austenite grain boundary after rough rolling (that is, before finish rolling) functions as a recrystallization nucleus during finish rolling. Therefore, the average grain size of the hot-rolled steel sheet can be refined by controlling a waiting time, from finish rolling to the start of cooling, cooling conditions, and the like, described below, in a state where the austenite grain size during rough rolling is reduced. In order to measure the austenite grain size after rough rolling, the steel sheet is cooled as rapidly as possible, for example, at a cooling rate of 10° C./sec or higher, a structure of a cross-section of the steel sheet is etched to make the austenite grain boundary stand out, and the measurement is performed using an optical microscope. At this time, 20 or more visual fields are observed at a magnification of 50 times or more and measured with an image analysis or cutting method.

During rolling (second hot rolling and third hot rolling) which is performed after rough rolling, endless rolling may be performed in which the rough bar obtained during rough rolling is joined between the rough rolling process (first hot rolling) and the finish hot rolling process (second hot rolling); and rolling is continuously performed. At this time, the rough bar may be temporarily coiled in the coil state, may be stored in a cover having, optionally, a heat insulation function, may be uncoiled again, and may be joined.

In addition, during finish rolling (second hot rolling), there may be a case in which it is preferable that temperature changes in the rolling direction, the transverse direction, and the through-thickness direction of the rough bar is controlled to be small. In this case, optionally, a heating apparatus capable controlling the temperature changes in the rolling direction, the transverse direction, and the through-thickness direction of the rough bar may be provided between a rough rolling mill and a finish rolling mill or between stands of finish rolling to heat the rough bar.

Examples of heating means include various kinds of heating measures such as gas heating, electrical heating, and induction heating. Any well-known measures may be used as long as it can control the temperature changes in the rolling direction, the transverse direction, and the through-thickness direction of the rough bar to be small.

As the heating measures, induction heating having industrially superior temperature control response is preferable. In particular, plural transverse induction heating apparatuses capable of shifting in the transverse direction is more preferable because it can appropriately control a temperature distribution in the transverse direction according to the width of the sheet. As the heating measures, a heating apparatus in which the plural transverse induction heating apparatuses and a solenoid induction heating apparatus which is superior for heating over the entire width of the sheet are combined is most preferable.

When the temperature is controlled using these heating apparatuses, it is necessary that the heating amount is controlled. In this case, the internal temperature of the rough bar cannot be actually measured. Therefore, a temperature distribution of the rough bar in the rolling direction, the transverse direction, and the through-thickness direction when the rough bar reaches the heating apparatus is estimated based on previously measured data of a charge slab temperature, a time for which a slab is present in a furnace, a heating furnace atmosphere temperature, a heating furnace extraction temperature, and a transport time of a table roller. It is preferable that the heating amount be controlled using the heating apparatus based the estimated values.

The heating amount is controlled as follows using the induction heating apparatus. The induction heating apparatus (transverse induction heating apparatus) generates a magnetic field in the inside thereof when an alternating current flows through a coil. Due to the electromagnetic induction action, an eddy current in a direction opposite to that the coil current is generated in a conductor, provided in the coil, in a circumferential direction perpendicular to a magnetic flux. Due to the Joule heat thereof, the conductor is heated.

The eddy current is most intensively generated on the inside surface of the coil and is exponentially reduced toward the inside (this phenomenon is referred to as the skin effect). As a frequency is lower, a current penetration depth is greater and a heating pattern, which is uniform in a thickness direction, is obtained. As a frequency is higher, a current penetration depth is less and a heating pattern, which has a peak on the surface layer and has a small amount of overheating in a thickness direction, is obtained.

Accordingly, in the transverse induction heating apparatus, heating in the rolling direction and the transverse direction of the rough bar can be performed in the same method as that of the related art.

During heating in the through-thickness direction, the penetration depth can be changed by changing the frequency of the transverse induction heating apparatus; and the temperature density can be made uniform by controlling the heating pattern in the through-thickness direction. In this case, a frequency-variable induction heating apparatus is preferably used, but the frequency may be changed by controlling a capacitor.

When the heating amount is controlled using the induction heating apparatus, plural inverters having different frequencies may be provided to change respective heating amounts and to thus obtain a heating pattern necessary in the thickness direction. During induction heating, when an air gap with a heating target is changed, the frequency is changed. Therefore, in order to control the heating amount using the induction heating apparatus, an air gap with a heating target may be changed to change the frequency and to thus obtain the desired heating pattern.

For example, as described in "Databook on Fatigue Strength of Metallic Materials" (The Society of Materials Science, Japan), the fatigue strength of a hot-rolled or pickled steel sheet has a relationship with the maximum height Ry (corresponding to Rz according to JIS B0601: 2001) on the steel sheet surface. Therefore, it is preferable that the maximum height Ry on the steel sheet surface after finish rolling is less than or equal to 15 μm (15 μmRy, 12.5 mm, 1 n 12.5 mm). In order to obtain this surface roughness, during descaling, it is preferable that a condition of "Impact Pressure P of High-Pressure Water on Steel Sheet Surface× Flow Rate L≥0.003" is satisfied.

In order to prevent the reproduction of scales after descaling, it is preferable that finish rolling is performed within 5 seconds after descaling. After the finish of rough rolling, finish rolling (second hot rolling) starts. A time from the finish of rough rolling to the start of finish rolling is set to be within 150 seconds. When the waiting time from the finish of rough rolling to the start of finish rolling is longer than 150 seconds, the average grain size in the steel sheet is increased and thus, toughness deteriorates. The lower limit is not particularly limited, but is preferably longer than or equal to 10 seconds when recrystallization is completely finished after rough rolling.

During finish rolling, a finish rolling start temperature is set to be higher than or equal to 1000° C. When the finish rolling start temperature is lower than 1000° C., in each finish rolling pass, a rolling temperature, at which the rough bar as the rolling target is heated, is reduced, rolling is performed in a non-recrystallization temperature range, a texture is developed, and isotropy deteriorates.

The upper limit of the finish rolling start temperature is not particularly limited. However, when the upper limit is higher than or equal to 1150° C., before finish rolling and between passes, there is a concern about a blister which causes spindle scales between ferrite of the steel sheet and a surface scale. Therefore, the finish rolling start temperature is preferably lower than 1150° C.

During finish rolling, when a temperature determined by components of the steel sheet is represented by T1, in a temperature range of (T1+30)° C. to (T1+200)° C., rolling is preformed at least once at a rolling reduction of 30% or higher so as to obtain a total rolling reduction of 50% or higher; and then hot rolling is finished at (T1+30)° C. or higher. T1 described herein represents the temperature which is calculated from the contents of respective elements according to the following expression (e).

$$T1=850+10\times([C]+[N])\times[Mn]+350\times[Nb]+250\times[Ti]+40\times[B]+10\times[Cr]+100\times[Mo]+100\times[V] \quad (e)$$

In the expression (e), the content of a chemical element (chemical component) which is not contained in the steel sheet is calculated as 0%.

This temperature T1 was empirically obtained. The present inventors empirically found that recrystallization was promoted in an austenite range based on the temperature T1. However, in the expression (e), the content of a chemical element (chemical component) which is not contained in the steel sheet is calculated as 0%.

When the total rolling reduction in the temperature range of (T1+30)° C. to (T1+200)° C. is lower than 50%, rolling strain accumulating during hot rolling is not sufficient, the recrystallization of austenite does not sufficiently advance, a texture is developed, isotropy deteriorates, and there is a concern that a sufficient grain refining effect cannot be obtained. Therefore, the total rolling reduction during finish rolling is set to be higher than or equal to 50%. When the total rolling reduction is higher than or equal to 70%, sufficient isotropy can be obtained even in consideration of variation caused by temperature changes and the like, that is more preferable.

On the other hand, when the total rolling reduction is higher than 90%, it is difficult to maintain a temperature range of (T1+200)° C. or lower due to deformation heating and the like. In addition, a rolling load is increased and rolling is difficult.

In order to promote uniform recrystallization by releasing accumulated strain, rolling is performed at least once at a rolling reduction of 30% or higher in one pass during rolling in which the total rolling reduction in the temperature range of (T1+30)° C. to (T1+200)° C. is 50% or higher.

After the finish of second hot rolling, in order to promote uniform recrystallization, it is preferable that the processing amount of the rolling in a temperature range of a Ar3 transformation temperature to less than (T1+30)° C. is suppressed to the minimum. To that end, a total rolling reduction during rolling (third hot rolling) in the temperature range of the Ar3 transformation temperature to less than (T1+30)° C. is limited to be lower than or equal to 30%. From the viewpoint of precision in sheet thickness and the shape of the sheet, a rolling reduction of 10% or lower is preferable. When isotropy is further required, a rolling reduction of 0% is preferable.

All the processes of first to third hot rolling are finished at the Ar3 transformation temperature or higher. During hot rolling in a temperature range of less than the Ar3 transformation temperature, dual phase rolling is performed and ductility deteriorates due to a residual deformed ferrite structure. Preferably, the hot rolling end temperature is higher than or equal to T1° C.

When a pass of a rolling reduction of 30% or higher in a temperature range of (T1+30)° C. to (T1+200)° C. is defined as a large reduction pass, primary cooling is performed under conditions of a cooling rate of 50° C./sec or higher, a temperature change of 40° C. to 140° C., and a cooling end temperature of (T1+100)° C. or lower such that a waiting time t (second) from the finish of a final pass of the large reduction pass to the start of cooling satisfies the following expression (f). When the waiting time t until the start of cooling is longer than 2.5×t1 seconds, recrystallized austenite grains are maintained at a high temperature, the grains are grown, and toughness deteriorates. During the first cooling, it is preferable that cooling is performed between rolling stands so as to cool the steel sheet with water as rapidly as possible after rolling. When a measuring apparatus such as a thermometer or a thickness meter is provided on a rear surface of a final rolling stand, the measurement is difficult due to steam and the like generated when cooling water is applied thereto. Therefore, it is difficult to provide a cooling apparatus immediately after the final rolling stand. It is preferable that second cooling is performed at a run-out table, which is provided after passage through the final rolling stand, so as to precisely control a precipitation state of a precipitate and a structure fraction of a microstructure in a narrow range. The cooling apparatus at the run-out table is suitable for controlling the above-described microstructure because feedback can be controlled through software by electrical signals which are output from a controller including plural water cooling valves controlled by solenoid valves.

$$t\leq 2.5\times t1 \quad (f)$$

(wherein t1 is represented by the following expression (g))

$$t1=0.001\times((Tf-T1)\times P1/100)^2-0.109\times((Tf-T1)\times P1/100)+3.1 \quad (g)$$

(wherein Tf represents the temperature (° C.) after final reduction at a rolling reduction of 30% or higher, and P1 represents the rolling reduction (%) during the final reduction at a rolling reduction of 30% or higher)

It was found that it is more preferable that the waiting time t is set to the time after the finish of the final pass of the large reduction pass, instead of the time after the finish of hot rolling, because substantially preferable recrystallization ratio and recrystallization grain size are obtained. As long as the waiting time until the start of cooling is as described above, any one of primary cooling and third hot rolling may be performed first.

The growth of recrystallized austenite grains can be further suppressed by limiting the cooling temperature change to 40° C. to 140° C. Furthermore, the development of a texture can be further suppressed by more efficiently controlling variant selection (avoidance of variant limit). When the temperature change during primary cooling is lower than 40° C., recrystallized austenite grains are grown and low-temperature toughness deteriorates. On the other hand, when the temperature change is higher than 140° C., there is a concern about overshooting of the temperature chanege in a temperature range of the Ar3 transformation temperature or lower. In this case, even when transformation is performed from recrystallized austenite, as a result of efficient control of variation selection, a texture is formed and isotropy deteriorates. In addition, when a steel sheet temperature at the time of finish of cooling is higher than (T1+100)° C., the cooling effect is not sufficiently obtained. The reason is as follows: even if primary cooling is performed after the final pass under appropriate conditions, when the steel sheet temperature at the time of finish of cooling is higher than (T1+100)° C., there is a concern that grains may be grown and austenite grains may be significantly coarsened.

When the cooling rate during primary cooling is lower than 50° C./sec, recrystallized austenite grains are grown and low-temperature toughness deteriorates. On the other hand, the upper limit of the cooling rate is not particularly limited, but is preferably lower than or equal to 200° C./sec from the viewpoint of the shape of the steel sheet.

When the waiting time t until the start of cooling is limited to be shorter than t1, the growth of grains is suppressed and superior toughness can be obtained.

When the waiting time t until the start of cooling is limited to satisfy an expression of $t1 \leq t \leq 2.5 \times t1$, the randomization of grains is sufficiently promoted and superior pole densities can be stably obtained.

Furthermore, secondary cooling is performed within 3 seconds after primary cooling at a cooling rate of 15° C./sec or higher.

The secondary cooling process greatly affects the size of cementite and the precipitation of carbides.

When the cooling rate is lower than 15° C./sec, the generation of precipitation nucleation of cementite competes against the generation of precipitation of TiC, NbC, and the like during cooling from the finish of finish rolling to coiling. As a result, the precipitation nucleation of cementite occurs first, cementite having a grain boundary of greater than 2 μm is produced in the coiling process, and hole expansibility deteriorates. In addition, due to the growth of cementite, the fine precipitation of carbides such as TiC and NbC is suppressed and the strength deteriorates.

In the cooling process, even when the upper limit of the cooling rate is not particularly limited, the effects of the embodiment can be obtained. However, the upper limit is preferably lower than or equal to 300° C./sec in consideration of the warpage of the steel sheet due to thermal strain.

When a time from the finish of primary cooling to the start of secondary cooling is longer than 3 seconds, grains are coarsened and the precipitation nucleation of cementite generates first. As a result, in the coiling process, cementite having a grain boundary of greater than 2 μm is produced and hole expansibility deteriorates. Furthermore, due to the growth of cementite, the fine precipitation of carbides such as TiC and NbC is suppressed and the strength deteriorates. Therefore, the time until the start of secondary cooling is set to be within 3 seconds. However, it is preferable that the time be shorter in a range of facility capacity.

A structure of the steel sheet is not particularly limited. However, in order to obtain superior stretch flangeability and burring workability, it is preferable that a continuous cooling transformation structure (Zw) is used as a microstructure. A cooling rate sufficient for obtaining this microstructure is higher than or equal to 15° C./sec. That is, a cooling rate for stably obtaining a continuous cooling transformation structure is approximately 15° C. to 50° C. Furthermore, as described in Examples, a cooling rate for more stably obtaining a continuous cooling transformation structure is lower than or equal to 30° C.

Furthermore, in order to suppress the growth of c grains and to obtain superior low-temperature toughness, it is preferable that a cooling apparatus and the like be provided between passes to control an temperature increase between passes of finish rolling (in the case of tandem rolling, between respective stands) to be lower than or equal to 18° C.

Regarding whether or not the above-described predetermined reduction is performed, the rolling reduction can be confirmed by calculation from actual results of rolling load, sheet thickness measurement, and the like. In addition, the temperature can also be measured when there is a thermometer between stands or can be obtained from a line speed, a rolling reduction, or the like by a calculation simulation in consideration of deformation heating and the like. Therefore, the temperature can be obtained in either or both of the methods.

In the production method according to the embodiment, a rolling rate is not particularly limited. However, when a rolling rate at a final stand of finish rolling is lower than 400 mpm, γ grains are likely to be coarsened. Therefore, there are concerns that a region in which ferrite for obtaining ductility can precipitate may be reduced and ductility may deteriorate. The effects of the embodiment can be obtained without particularly limiting the upper limit of the rolling rate. However, the upper limit is practically lower than or equal to 1800 mpm due to facility limitation. Therefore, the rolling rate during finish rolling is preferably 400 mpm to 1800 mpm.

When a continuous cooling transformation structure (Zw) is used as a primary phase of a microstructure, in order to improve ductility with small deterioration in burring workability, optionally, the structure may contain polygonal ferrite having a volume fraction of 20% or lower. In this case, during the secondary cooling process which is performed before the coiling process and after the finish of primary cooling (between the start of secondary cooling and the finish of secondary cooling), or during a period from the finish of secondary cooling to the start of coiling, a temperature range (dual phase of ferrite and austenite) from the Ar3 transformation temperature to an Ar1 transformation temperature may be retained for 1 second to 20 seconds.

In the case where the temperature is retained, for example, when secondary cooling is performed at a run-out table after passage through the final rolling stand, cooling is temporarily stopped and the temperature can be retained in a predetermined range by closing a water cooling valve in an intermediate zone between cooling zones of secondary cooling. In addition, for example, when secondary cooling is performed between rolling stands or immediately after passage through the rolling stands, the temperature can be maintained in a predetermined range by performing air-cooling during a period from the finish of secondary cooling to the start of coiling.

The temperature is retained in order to promote ferrite transformation in the dual phase. When the retention time is shorter than 1 seconds, ferrite transformation in the dual phase is insufficient and thus, sufficient ductility cannot be obtained. On the other hand, when the retention time is longer than 20 seconds, precipitates containing Ti and/or Nb are coarsened, which does not contribute to the improvement of strength by precipitation strengthening. Therefore, in the cooling process, the retention time for making the continuous cooling transformation structure contain polygonal ferrite is preferably 1 second to 20 seconds.

In order to promote ferrite transformation, the temperature range which is retained for 1 second to 20 seconds is preferably the Ar1 transformation temperature to 860° C. In order to suppress variation caused by components of the steel sheet, the temperature range is more preferably lower than or equal to the Ar3 transformation temperature. In order not to reduce productivity, the retention time is preferably 1 second to 10 seconds.

When the retention is performed during secondary cooling, after the finish of third hot rolling, it is preferable that the temperature reach the temperature range of the Ar3 transformation temperature to the Ar1 transformation temperature rapidly at a cooling rate of 20° C./sec or higher.

In this case, the upper limit of the cooling rate is not particularly limited, but is preferably lower than or equal to 300° C./sec in consideration of cooling facility capacity. When the cooling rate is excessively high, there is a possibility that the cooling end temperature cannot be controlled, overshooting may occur, and overcooling to the Ar1 transformation temperature or lower may occur. When overcooling to the Ar1 transformation temperature or lower occurs, the effect of improving ductility is lost. Therefore, the cooling rate is preferably lower than or equal to 150° C./sec.

The Ar3 transformation temperature can be easily calculated from the following expression (relational expression between chemical components). The following expression (j) can be defined using the content [Si] (mass %) of Si, the content [Cr] (mass %) of Cr, the content [Cu] (mass %) of Cu, the content [Mo] (mass %) of Mo, and the content [Ni] (mass %) of Ni.

$$Ar3=910-310\times[C]+25\times[Si]-80\times[Mneq] \quad (j)$$

[Mneq] is defined by the following expression (k) when B is not added.

$$[Mneq]=[Mn]+[Cr]+[Cu]+[Mo]+[Ni]/2+10\times([Nb]-0.02) \quad (k)$$

[Mneq] is defined by the following expression (1) when B is added.

$$[Mneq]=[Mn]+[Cr]+[Cu]+[Mo]+[Ni]/2+10\times([Nb]-0.02)+1 \quad (l)$$

In addition, as the Ar1 transformation temperature, the values experimentally obtained by performing a working Formaster test for each component can be used.

The above-described secondary cooling process and the coiling process after secondary cooling greatly affect the size and number density of precipitates containing TiC. When a coiling temperature is higher than or equal to 700° C., the precipitates are in the over-aging state of being coarse and sparse. As a result, the desired amount of precipitation strengthening may not be obtained or toughness may deteriorate. When the coiling temperature is lower than 700° C., the effect of precipitation strengthening in a longitudinal direction of a coil can be stably obtained.

On the other hand, when the coiling temperature is lower than 550° C., aging is insufficient and thus, the desired precipitation of TiC cannot be obtained. Therefore, the coiling temperature is preferably 550° C. to lower than 700° C. In order to more stably obtain the effect of precipitation strengthening, the coiling temperature is preferably 550° C. and 650° C.

Figure 3:
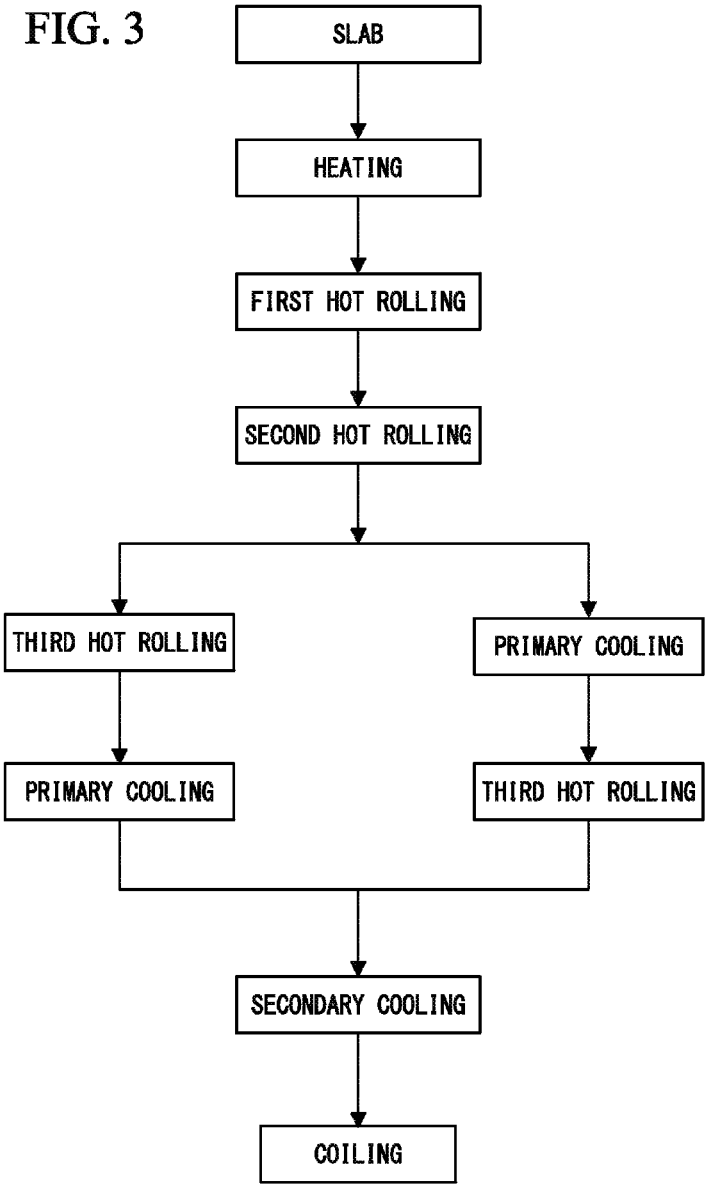
FIG. 3 is a flowchart illustrating a method of producing a hot-rolled steel sheet according to an embodiment of the present invention.

For reference, FIG. 3 is a flowchart schematically illustrating the method of producing a hot-rolled steel sheet according to the embodiment.

In order to improve ductility by correcting the shape of the steel sheet or by introducing a moving dislocation, skin pass rolling may be further performed at a rolling reduction of 0.1% to 2% after the finish of all the processes.

After the finish of the above-described rolling and cooling processes, pickling may be performed in order to remove scales attached onto the surface of the obtained hot-rolled steel sheet. After pickling, the hot-rolled steel sheet may be further subjected to skin pass rolling at a rolling reduction of 10% or lower; or cold rolling in an in-line or off-line manner.

In the hot-rolled steel sheet according to the embodiment, in any case of after casting, after hot rolling, and after cooling, a heat treatment may be performed in a hot dip plating line. Furthermore, the hot-rolled steel sheet after the heat treatment may be subjected to a surface treatment separately. By performing plating in the hot dip plating line, the corrosion resistance of the hot-rolled steel sheet is improved.

When the hot-rolled steel sheet after pickling is subjected to zinc-plating, the hot-rolled steel sheet may be dipped in a zinc plating bath, pull over, and optionally be subjected to an alloying treatment. By performing the alloying treatment, the corrosion resistance is improved and the welding resistance to various kinds of welding such as spot welding is also improved.

Examples

Next, examples of the present invention will be described. Conditions in the examples are merely examples of conditions examples which are adopted for confirming the operability and effects of the present invention. The present invention is not limited to these examples of conditions. The present invention can adopt various kinds of conditions within a range not departing from the concepts of the present invention and achieving the object of the present invention.

Slabs A to W having chemical compositions as shown in Table 1 were melted in a converter in a secondary refining process; were continuously casted; and were directly fed or reheated to perform rough rolling (first hot rolling). Next, finish rolling (second hot rolling), third hot rolling, and primary cooling between rolling stands were performed to obtain sheets having a thickness of 2.0 mm to 3.6 mm. Furthermore, secondary cooling was performed at a run-out table and coiling was performed to prepare hot-rolled steel sheets. Production conditions are as shown in Tables 2 to 9.

The balance of chemical compositions shown in Table 1 are Fe and unavoidable impurities. The underline in the table represents being out of the range of the present invention.

TABLE 1

Mass %

| STEEL | C | Si | Mn | P | S | Al | N | Ti | Nb | Cu | Ni | Mo | V | Cr | B | Mg | Ca | Rem | OTHERS | EXPRESSION a | EXPRESSIONS b AND c | NOTE |
|---|---|---|---|---|---|---|---|---|---|---|---|---|---|---|---|---|---|---|---|---|---|---|
| A | 0.069 | 1.20 | 2.51 | 0.016 | 0.003 | 0.023 | 0.0026 | 0.144 | 0.020 | 0.00 | 0.00 | 0.00 | 0.00 | 0.00 | 0.0014 | 0.0022 | 0.0000 | 0.0000 | — | 0.1306 | 0.0338 | STEEL ACCORDING TO PRESENT INVENTION |
| B | 0.071 | 1.17 | 2.46 | 0.011 | 0.002 | 0.029 | 0.0040 | 0.179 | 0.017 | 0.00 | 0.00 | 0.00 | 0.00 | 0.00 | 0.0000 | 0.0000 | 0.0024 | 0.0000 | — | 0.1623 | 0.0282 | STEEL FOR COMPARISON |
| C | 0.067 | 0.14 | 1.98 | 0.007 | 0.001 | 0.011 | 0.0046 | 0.091 | 0.038 | 0.00 | 0.00 | 0.00 | 0.00 | 0.00 | 0.0000 | 0.0019 | 0.0000 | 0.0000 | — | 0.0737 | 0.0437 | STEEL ACCORDING TO PRESENT INVENTION |
| D | 0.036 | 0.94 | 1.34 | 0.008 | 0.001 | 0.020 | 0.0028 | 0.126 | 0.041 | 0.00 | 0.00 | 0.00 | 0.00 | 0.00 | 0.0000 | 0.0000 | 0.0000 | 0.0000 | — | 0.1149 | 0.0020 | STEEL ACCORDING TO PRESENT INVENTION |
| E | 0.043 | 0.98 | 0.98 | 0.010 | 0.001 | 0.036 | 0.0034 | 0.099 | 0.000 | 0.00 | 0.00 | 0.00 | 0.00 | 0.00 | 0.0009 | 0.0000 | 0.0021 | 0.0000 | — | 0.0858 | 0.0215 | STEEL ACCORDING TO PRESENT INVENTION |
| F | 0.042 | 0.73 | 1.04 | 0.011 | 0.001 | 0.024 | 0.0041 | 0.035 | 0.019 | 0.00 | 0.00 | 0.00 | 0.00 | 0.00 | 0.0000 | 0.0000 | 0.0000 | 0.0018 | — | 0.0194 | 0.0347 | STEEL ACCORDING TO PRESENT INVENTION |
| G | 0.089 | 0.91 | 1.20 | 0.008 | 0.0011 | 0.033 | 0.0038 | 0.000 | 0.000 | 0.00 | 0.00 | 0.00 | 0.00 | 0.00 | 0.0000 | 0.0000 | 0.0022 | 0.0000 | — | −0.0147 | 0.0927 | STEEL FOR COMPARISON |
| H | 0.180 | 0.03 | 0.72 | 0.017 | 0.004 | 0.011 | 0.0035 | 0.025 | 0.000 | 0.00 | 0.00 | 0.00 | 0.00 | 0.00 | 0.0000 | 0.0000 | 0.0000 | 0.0000 | — | 0.0070 | 0.1783 | STEEL FOR COMPARISON |
| I | 0.022 | 0.05 | 1.12 | 0.009 | 0.004 | 0.025 | 0.0047 | 0.102 | 0.000 | 0.00 | 0.00 | 0.00 | 0.00 | 0.00 | 0.0011 | 0.0000 | 0.0000 | 0.0020 | Co: 0.001 | 0.0799 | 0.0020 | STEEL ACCORDING TO PRESENT INVENTION |
| J | 0.004 | 0.12 | 1.61 | 0.080 | 0.002 | 0.041 | 0.0027 | 0.025 | 0.025 | 0.00 | 0.00 | 0.00 | 0.00 | 0.00 | 0.0011 | 0.0000 | 0.0000 | 0.0020 | — | 0.0127 | −0.0024 | STEEL FOR COMPARISON |
| K | 0.230 | 0.18 | 0.74 | 0.017 | 0.002 | 0.005 | 0.0051 | 0.000 | 0.000 | 0.00 | 0.00 | 0.00 | 0.00 | 0.00 | 0.0000 | 0.0000 | 0.0000 | 0.0020 | — | −0.0205 | 0.2351 | STEEL FOR COMPARISON |
| L | 0.057 | 1.21 | 2.46 | 0.013 | 0.002 | 0.023 | 0.0026 | 0.210 | 0.015 | 0.00 | 0.00 | 0.00 | 0.00 | 0.00 | 0.0000 | 0.0000 | 0.0024 | 0.0000 | — | 0.1981 | 0.0055 | STEEL FOR COMPARISON |
| M | 0.061 | 1.24 | 2.53 | 0.011 | 0.003 | 0.023 | 0.0026 | 0.137 | 0.110 | 0.00 | 0.00 | 0.00 | 0.00 | 0.00 | 0.0000 | 0.0000 | 0.0000 | 0.0020 | — | 0.1236 | 0.0159 | STEEL FOR COMPARISON |
| N | 0.065 | 0.15 | 2.00 | 0.017 | 0.004 | 0.011 | 0.0041 | 0.088 | 0.034 | 0.06 | 0.03 | 0.00 | 0.00 | 0.00 | 0.0000 | 0.0000 | 0.0000 | 0.0000 | — | 0.0679 | 0.0436 | STEEL ACCORDING TO PRESENT INVENTION |
| O | 0.036 | 0.96 | 1.27 | 0.009 | 0.004 | 0.025 | 0.0038 | 0.124 | 0.037 | 0.00 | 0.03 | 0.00 | 0.00 | 0.00 | 0.0000 | 0.0000 | 0.0000 | 0.0000 | — | 0.1050 | 0.0050 | STEEL ACCORDING TO PRESENT INVENTION |

TABLE 1-continued

Mass %

| STEEL | C | Si | Mn | P | S | Al | N | Ti | Nb | Cu | Ni | Mo | V | Cr | B | Mg | Ca | Rem | OTHERS | EXPRESSION a | EXPRESSIONS b AND c | NOTE |
|---|---|---|---|---|---|---|---|---|---|---|---|---|---|---|---|---|---|---|---|---|---|---|
| P | 0.041 | 1.01 | 0.94 | 0.080 | 0.002 | 0.041 | 0.0035 | 0.102 | 0.000 | 0.00 | 0.00 | 0.48 | 0.00 | 0.00 | 0.0010 | 0.0000 | 0.0000 | 0.0000 | Zr: 0.002 | 0.0870 | 0.0193 | STEEL ACCORDING TO PRESENT INVENTION |
| Q | 0.064 | 1.22 | 2.52 | 0.017 | 0.002 | 0.005 | 0.0047 | 0.140 | 0.018 | 0.00 | 0.00 | 0.00 | 0.10 | 0.00 | 0.0000 | 0.0000 | 0.0000 | 0.0000 | — | 0.1209 | 0.0315 | STEEL ACCORDING TO PRESENT INVENTION |
| R | 0.038 | 0.74 | 0.99 | 0.013 | 0.002 | 0.023 | 0.0027 | 0.034 | 0.022 | 0.00 | 0.00 | 0.00 | 0.00 | 0.91 | 0.0000 | 0.0000 | 0.0000 | 0.0000 | — | 0.0217 | 0.0297 | STEEL ACCORDING TO PRESENT INVENTION |
| S | 0.049 | 0.01 | 2.94 | 0.010 | 0.001 | 0.750 | 0.0050 | 0.192 | 0.000 | 0.00 | 0.00 | 0.00 | 0.00 | 0.00 | 0.0000 | 0.0000 | 0.0000 | 0.0000 | — | 0.1734 | 0.0057 | PRESENT INVENTION |
| T | 0.044 | 2.20 | 0.20 | 0.009 | 0.001 | 0.008 | 0.0009 | 0.020 | 0.000 | 0.00 | 0.00 | 0.00 | 0.00 | 0.00 | 0.0003 | 0.0000 | 0.0000 | 0.0000 | — | 0.0154 | 0.0401 | PRESENT INVENTION |
| U | 0.045 | 0.75 | 1.02 | 0.011 | 0.001 | 0.024 | 0.0020 | 0.010 | 0.000 | 0.00 | 0.00 | 0.00 | 0.00 | 0.00 | 0.0005 | 0.0000 | 0.0000 | 0.0000 | — | 0.0016 | 0.0446 | STEEL FOR COMPARISON |
| V | 0.035 | 0.92 | 1.32 | 0.009 | 0.001 | 0.020 | 0.0059 | 0.170 | 0.000 | 0.00 | 0.00 | 0.00 | 0.00 | 0.00 | 0.0000 | 0.0000 | 0.0000 | 0.0000 | — | 0.1483 | −0.0021 | STEEL FOR COMPARISON |
| W | 0.033 | 0.95 | 1.33 | 0.008 | 0.001 | 0.021 | 0.0058 | 0.016 | 0.000 | 0.00 | 0.00 | 0.00 | 0.00 | 0.00 | 0.0000 | 0.0000 | 0.0000 | 0.0000 | — | −0.0054 | 0.0343 | STEEL FOR COMPARISON |

TABLE 2

| | STEEL NO. | METALLURGICAL FACTORS (1) | (2) | (3) | (4) | T1 (° C.) | PRODUCTION CONDITIONS: HEATING TEMPERATURE CONDITIONS (5) | (6) | FIRST HOT ROLLING (7) | (8) | (9) | (10) | (11) | SECOND HOT ROLLING (12) | (13) | Tf (° C.) | P1 (%) | (14) | (15) |
|---|---|---|---|---|---|---|---|---|---|---|---|---|---|---|---|---|---|---|---|
| STEEL ACCORDING TO PRESENT INVENTION | 1 | A | 1200 | 638 | 488 | 895 | 1260 | 45 | 2 | 45/45 | 100 | 1080 | 60 | 1050 | 90 | 990 | 40 | 1 | 15 |
| STEEL FOR COMPARISON | 2 | B | 1234 | 723 | 573 | 903 | 1260 | 45 | 2 | 45/45 | 100 | 1080 | 60 | 1050 | 90 | 990 | 40 | 1 | 12 |
| STEEL ACCORDING TO PRESENT INVENTION | 3 | D | 1137 | 720 | 570 | 887 | 1230 | 45 | 1 | 50 | 180 | 1050 | 60 | 1040 | 93 | 980 | 35 | 2 | 15 |
| STEEL FOR COMPARISON | 4 | D | 1137 | 720 | 570 | 887 | 1120 | 45 | 1 | 50 | 110 | 1010 | 30 | 1000 | 93 | 930 | 35 | 2 | 15 |
| STEEL ACCORDING TO PRESENT INVENTION | 5 | D | 1137 | 720 | 570 | 887 | 1230 | 5 | 1 | 50 | 140 | 1050 | 60 | 1030 | 93 | 970 | 35 | 2 | 15 |
| STEEL FOR COMPARISON | 6 | D | 1137 | 720 | 570 | 887 | 1230 | 45 | 0 | — | 240 | 1065 | 60 | 1040 | 93 | 980 | 35 | 2 | 15 |
| STEEL FOR COMPARISON | 7 | D | 1137 | 720 | 570 | 887 | 1230 | 45 | 1 | 50 | 140 | 1050 | 180 | 1010 | 93 | 950 | 35 | 2 | 15 |
| STEEL FOR COMPARISON | 8 | D | 1137 | 720 | 570 | 887 | 1230 | 45 | 1 | 50 | 140 | 1050 | 60 | 1040 | 45 | 980 | 35 | 2 | 15 |
| STEEL FOR COMPARISON | 9 | D | 1137 | 720 | 570 | 887 | 1230 | 45 | 1 | 50 | 140 | 1050 | 60 | 910 | 93 | 850 | 35 | 2 | 15 |
| STEEL FOR COMPARISON | 10 | D | 1137 | 720 | 570 | 887 | 1260 | 45 | 1 | 50 | 140 | 1050 | 30 | 1110 | 93 | 1050 | 35 | 2 | 15 |
| STEEL FOR COMPARISON | 11 | D | 1137 | 720 | 570 | 887 | 1230 | 45 | 1 | 50 | 140 | 1050 | 60 | 1040 | 93 | 980 | — | 0 | 15 |
| STEEL ACCORDING TO PRESENT INVENTION | 12 | D | 1137 | 720 | 570 | 887 | 1230 | 45 | 1 | 50 | 140 | 1050 | 60 | 1040 | 93 | 980 | 35 | 2 | 25 |
| STEEL ACCORDING TO PRESENT INVENTION | 13 | D | 1137 | 720 | 570 | 887 | 1230 | 45 | 1 | 50 | 140 | 1050 | 60 | 1040 | 93 | 980 | 35 | 2 | 15 |
| STEEL FOR COMPARISON | 14 | D | 1137 | 720 | 570 | 887 | 1230 | 45 | 1 | 50 | 140 | 1050 | 60 | 1040 | 93 | 980 | 35 | 2 | 15 |
| STEEL FOR COMPARISON | 15 | D | 1137 | 720 | 570 | 887 | 1230 | 45 | 1 | 50 | 140 | 1050 | 60 | 1040 | 93 | 980 | 35 | 2 | 15 |
| STEEL FOR COMPARISON | 16 | D | 1137 | 720 | 570 | 887 | 1230 | 45 | 1 | 50 | 140 | 1050 | 60 | 1040 | 93 | 980 | 35 | 2 | 15 |
| STEEL FOR COMPARISON | 17 | D | 1137 | 720 | 570 | 887 | 1230 | 45 | 1 | 50 | 140 | 1050 | 60 | 1040 | 93 | 980 | 35 | 2 | 15 |
| STEEL FOR COMPARISON | 18 | D | 1137 | 720 | 570 | 887 | 1230 | 45 | 1 | 50 | 140 | 1050 | 60 | 1040 | 93 | 980 | 35 | 2 | 15 |
| STEEL FOR COMPARISON | 19 | D | 1137 | 720 | 570 | 887 | 1230 | 45 | 1 | 50 | 140 | 1050 | 60 | 1040 | 93 | 980 | 35 | 2 | 15 |
| STEEL FOR COMPARISON | 20 | D | 1137 | 720 | 570 | 887 | 1230 | 45 | 1 | 50 | 140 | 1050 | 60 | 1040 | 93 | 980 | 35 | 2 | 15 |

(1) COMPONENT
(2) SOLUTION TEMPERATURE (° C.)
(3) Ar3 TRANSFORMATION TEMPERATURE (° C.)
(4) Ar1 TRANSFORMATION TEMPERATURE (° C.)
(5) HEATING TEMPERATURE (° C.)
(6) RETENTION TIME (MIN)
(7) NUMBER OF ROLLING OF 40% OR HIGHER AT 1000° C. OR HIGHER
(8) ROLLING REDUCTION (%) OF 40% OR HIGHER AT 1000° C. OR HIGHER (%)
(9) γ GRAIN SIZE (μm) (10) ROLLING END TEMPERATURE (° C.)
(11) TIME (SEC) UNTIL START OF FINISH ROLLING
(12) ROLLING START TEMPERATURE (° C.)
(13) TOTAL ROLLING REDUCTION (%)
(14) NUMBER OF PASSES AT ROLLING REDUCTION OF 30% OR HIGHER
(15) MAXIMUM TEMPERATURE INCREASE (° C.) BETWEEN PASSES

TABLE 3

| | STEEL NO. | METALLURGICAL FACTORS (1) | (2) | (3) | (4) | T1 (° C.) | PRODUCTION CONDITIONS: HEATING TEMPERATURE CONDITIONS (5) | (6) | FIRST HOT ROLLING (7) | (8) | (9) | (10) | (11) | SECOND HOT ROLLING (12) | (13) | Tf (° C.) | P1 (%) | (14) | (15) |
|---|---|---|---|---|---|---|---|---|---|---|---|---|---|---|---|---|---|---|---|
| STEEL ACCORDING TO PRESENT INVENTION | 21 | C | 1101 | 798 | 648 | 896 | 1200 | 60 | 3 | 40/40/40 | 70 | 1100 | 90 | 1050 | 89 | 990 | 32 | 3 | 12 |
| STEEL ACCORDING TO PRESENT INVENTION | 22 | E | 1094 | 779 | 629 | 875 | 1200 | 60 | 3 | 40/40/40 | 70 | 1100 | 90 | 1030 | 89 | 970 | 32 | 3 | 12 |
| STEEL ACCORDING TO PRESENT INVENTION | 23 | F | 981 | 833 | 683 | 866 | 1200 | 60 | 3 | 40/40/40 | 70 | 1100 | 90 | 1020 | 89 | 960 | 32 | 3 | 12 |
| STEEL FOR COMPARISON | 24 | G | — | 825 | 675 | 851 | 1200 | 60 | 3 | 40/40/40 | 70 | 1100 | 90 | 1010 | 89 | 950 | 32 | 3 | 12 |
| STEEL FOR COMPARISON | 25 | H | 1100 | 813 | 663 | 858 | 1200 | 60 | 3 | 40/40/40 | 70 | 1100 | 90 | 1010 | 89 | 950 | 32 | 3 | 12 |
| STEEL ACCORDING TO PRESENT INVENTION | 26 | I | 1024 | 751 | 601 | 876 | 1200 | 60 | 3 | 40/40/40 | 70 | 1100 | 90 | 1020 | 89 | 960 | 32 | 3 | 12 |
| STEEL FOR COMPARISON | 27 | J | 764 | 699 | 549 | 865 | 1200 | 60 | 3 | 40/40/40 | 70 | 1100 | 90 | 1010 | 89 | 950 | 32 | 3 | 12 |
| STEEL FOR COMPARISON | 28 | K | — | 800 | 650 | 852 | 1200 | 60 | 3 | 40/40/40 | 70 | 1100 | 90 | 1000 | 89 | 940 | 32 | 3 | 12 |
| STEEL FOR COMPARISON | 29 | L | 1225 | 730 | 580 | 909 | 1230 | 60 | 3 | 40/40/40 | 70 | 1100 | 90 | 1050 | 89 | 990 | 32 | 3 | 12 |
| STEEL FOR COMPARISON | 30 | M | 1177 | 648 | 498 | 924 | 1230 | 60 | 3 | 40/40/40 | 70 | 1100 | 90 | 1050 | 89 | 990 | 32 | 3 | 12 |
| STEEL ACCORDING TO PRESENT INVENTION | 31 | N | 1129 | 716 | 566 | 885 | 1230 | 60 | 3 | 40/40/40 | 70 | 1100 | 90 | 1030 | 89 | 970 | 32 | 3 | 12 |
| STEEL ACCORDING TO PRESENT INVENTION | 32 | O | 1099 | 806 | 656 | 894 | 1230 | 60 | 3 | 40/40/40 | 70 | 1180 | 90 | 1140 | 89 | 980 | 32 | 3 | 12 |
| STEEL ACCORDING TO PRESENT INVENTION | 33 | P | 1092 | 745 | 595 | 924 | 1230 | 60 | 3 | 40/40/40 | 70 | 1100 | 90 | 1050 | 89 | 990 | 32 | 3 | 12 |
| STEEL ACCORDING TO PRESENT INVENTION | 34 | Q | 1186 | 721 | 571 | 903 | 1200 | 60 | 3 | 40/40/40 | 70 | 1100 | 90 | 1050 | 89 | 990 | 32 | 3 | 12 |
| STEEL ACCORDING TO PRESENT INVENTION | 35 | R | 968 | 763 | 613 | 876 | 1230 | 60 | 3 | 40/40/40 | 70 | 1100 | 90 | 1040 | 89 | 980 | 32 | 3 | 12 |
| STEEL ACCORDING TO PRESENT INVENTION | 36 | S | 1193 | 676 | 526 | 900 | 1250 | 40 | 2 | 45/45 | 90 | 1075 | 120 | 1030 | 55 | 970 | 45 | 2 | 10 |
| STEEL ACCORDING TO PRESENT INVENTION | 37 | T | 933 | 871 | 721 | 855 | 1250 | 40 | 2 | 45/45 | 90 | 1075 | 120 | 1030 | 70 | 970 | 45 | 2 | 10 |
| STEEL FOR COMPARISON | 38 | T | 933 | 871 | 721 | 855 | 1250 | 40 | 2 | 45/45 | 90 | 1075 | 120 | 1030 | 70 | 970 | 45 | 2 | 10 |
| STEEL FOR COMPARISON | 39 | U | 875 | 769 | 619 | 853 | 1250 | 40 | 2 | 45/45 | 90 | 1075 | 120 | 1030 | 70 | 970 | 45 | 2 | 10 |

TABLE 3-continued

| | STEEL NO. | METALLURGICAL FACTORS (1) | (2) | (3) | (4) | T1 (° C.) | PRODUCTION CONDITIONS: HEATING TEMPERATURE CONDITIONS (5) | (6) | FIRST HOT ROLLING (7) | (8) | (9) | (10) | (11) | SECOND HOT ROLLING (12) | (13) | Tf (° C.) | P1 (%) | (14) | (15) |
|---|---|---|---|---|---|---|---|---|---|---|---|---|---|---|---|---|---|---|---|
| STEEL FOR COMPARISON | 40 | V | 1134 | 833 | 683 | 893 | 1250 | 40 | 2 | 45/45 | 90 | 1075 | 120 | 1030 | 70 | 970 | 45 | 2 | 10 |

(1) COMPONENT
(2) SOLUTION TEMPERATURE (° C.)
(3) Ar3 TRANSFORMATION TEMPERATURE (° C.)
(4) Ar1 TRANSFORMATION TEMPERATURE (° C.)
(5) HEATING TEMPERATURE (° C.)
(6) RETENTION TIME (MIN)
(7) NUMBER OF ROLLING OF 40% OR HIGHER AT 1000° C. OR HIGHER
(8) ROLLING REDUCTION (%) OF 40% OR HIGHER AT 1000° C. OR HIGHER (%)
(9) γ GRAIN SIZE (μm)
(10) ROLLING END TEMPERATURE (° C.)
(11) TIME (SEC) UNTIL START OF FINISH ROLLING
(12) ROLLING START TEMPERATURE (° C.)
(13) TOTAL ROLLING REDUCTION (%)
(14) NUMBER OF PASSES AT ROLLING REDUCTION OF 30% OR HIGHER
(15) MAXIMUM TEMPERATURE INCREASE (° C.) BETWEEN PASSES

TABLE 4

| | STEEL NO. | METALLURGICAL FACTORS (1) | (2) | (3) | (4) | T1 (° C.) | PRODUCTION CONDITIONS: HEATING TEMPERATURE CONDITIONS (5) | (6) | FIRST HOT ROLLING (7) | (8) | (9) | (10) | (11) | SECOND HOT ROLLING (12) | (13) | Tf (° C.) | P1 (%) | (14) | (15) |
|---|---|---|---|---|---|---|---|---|---|---|---|---|---|---|---|---|---|---|---|
| STEEL FOR COMPARISON | 41 | W | 888 | 833 | 683 | 855 | 1250 | 40 | 2 | 45/45 | 90 | 1075 | 120 | 1030 | 70 | 970 | 45 | 2 | 10 |
| STEEL ACCORDING TO PRESENT INVENTION | 42 | A | 1200 | 638 | 488 | 895 | 1260 | 45 | 2 | 45/45 | 100 | 1080 | 60 | 1050 | 90 | 990 | 40 | 1 | 15 |
| STEEL FOR COMPARISON | 43 | B | 1234 | 723 | 573 | 903 | 1260 | 45 | 2 | 45/45 | 100 | 1080 | 60 | 1050 | 90 | 990 | 40 | 1 | 12 |
| STEEL ACCORDING TO PRESENT INVENTION | 44 | D | 1137 | 720 | 570 | 887 | 1230 | 45 | 1 | 50 | 140 | 1050 | 60 | 1040 | 93 | 980 | 35 | 2 | 15 |
| STEEL FOR COMPARISON | 45 | D | 1137 | 720 | 570 | 887 | 1120 | 45 | 1 | 50 | 110 | 1010 | 30 | 1000 | 93 | 930 | 35 | 2 | 15 |
| STEEL ACCORDING TO PRESENT INVENTION | 46 | D | 1137 | 720 | 570 | 887 | 1230 | 5 | 1 | 50 | 140 | 1050 | 60 | 1030 | 93 | 970 | 35 | 2 | 15 |
| STEEL FOR COMPARISON | 47 | D | 1137 | 720 | 570 | 887 | 1230 | 45 | 0 | — | 240 | 1065 | 60 | 1040 | 93 | 980 | 35 | 2 | 15 |

TABLE 4-continued

| | | | | | | | PRODUCTION CONDITIONS | | | | | | | | | | | | |
|---|---|---|---|---|---|---|---|---|---|---|---|---|---|---|---|---|---|---|---|
| | | METALLURGICAL FACTORS | | | | | HEATING TEMPERATURE CONDITIONS | | FIRST HOT ROLLING | | | | | SECOND HOT ROLLING | | | | | |
| | STEEL NO. | (1) | (2) | (3) | (4) | T1 (° C.) | (5) | (6) | (7) | (8) | (9) | (10) | (11) | (12) | (13) | Tf (° C.) | P1 (%) | (14) | (15) |
| STEEL FOR COMPARISON | 48 | D | 1137 | 720 | 570 | 887 | 1230 | 45 | 1 | 50 | 140 | 1050 | 180 | 1010 | 93 | 950 | 35 | 2 | 15 |
| STEEL FOR COMPARISON | 49 | D | 1137 | 720 | 570 | 887 | 1230 | 45 | 1 | 50 | 140 | 1050 | 60 | 1040 | 45 | 980 | 35 | 2 | 15 |
| STEEL FOR COMPARISON | 50 | D | 1137 | 720 | 570 | 887 | 1230 | 45 | 1 | 50 | 140 | 1050 | 60 | 910 | 93 | 850 | 35 | 2 | 15 |
| STEEL FOR COMPARISON | 51 | D | 1137 | 720 | 570 | 887 | 1260 | 45 | 1 | 50 | 140 | 1050 | 30 | 1110 | 93 | 1050 | 35 | 2 | 15 |
| STEEL FOR COMPARISON | 52 | D | 1137 | 720 | 570 | 887 | 1230 | 45 | 1 | 50 | 140 | 1050 | 60 | 1040 | 93 | 980 | — | 0 | 15 |
| STEEL FOR COMPARISON | 53 | D | 1137 | 720 | 570 | 887 | 1230 | 45 | 1 | 50 | 140 | 1050 | 60 | 1040 | 93 | 980 | 35 | 2 | 25 |
| STEEL FOR COMPARISON | 54 | D | 1137 | 720 | 570 | 887 | 1230 | 45 | 1 | 50 | 140 | 1050 | 60 | 1040 | 93 | 980 | 35 | 2 | 15 |
| STEEL FOR COMPARISON | 55 | D | 1137 | 720 | 570 | 887 | 1230 | 45 | 1 | 50 | 140 | 1050 | 60 | 1040 | 93 | 980 | 35 | 2 | 15 |
| STEEL FOR COMPARISON | 56 | D | 1137 | 720 | 570 | 887 | 1230 | 45 | 1 | 50 | 140 | 1050 | 60 | 1040 | 93 | 980 | 35 | 2 | 15 |
| STEEL FOR COMPARISON | 57 | D | 1137 | 720 | 570 | 887 | 1230 | 45 | 1 | 50 | 140 | 1050 | 60 | 1040 | 93 | 980 | 35 | 2 | 15 |
| STEEL FOR COMPARISON | 58 | D | 1137 | 720 | 570 | 887 | 1230 | 45 | 1 | 50 | 140 | 1050 | 60 | 1040 | 93 | 980 | 35 | 2 | 15 |
| STEEL FOR COMPARISON | 59 | D | 1137 | 720 | 570 | 887 | 1230 | 45 | 1 | 50 | 140 | 1050 | 60 | 1040 | 93 | 980 | 35 | 2 | 15 |
| STEEL FOR COMPARISON | 60 | D | 1137 | 720 | 570 | 887 | 1230 | 45 | 1 | 50 | 140 | 1050 | 60 | 1040 | 93 | 980 | 35 | 2 | 15 |

(1) COMPONENT
(2) SOLUTION TEMPERATURE (° C.)
(3) Ar3 TRANSFORMATION TEMPERATURE (° C.)
(4) Ar1 TRANSFORMATION TEMPERATURE (° C.)
(5) HEATING TEMPERATURE (° C.)
(6) RETENTION TIME (MIN)
(7) NUMBER OF ROLLING OF 40% OR HIGHER AT 1000° C. OR HIGHER
(8) ROLLING REDUCTION (%) OF 40% OR HIGHER AT 1000° C. OR HIGHER (%)
(9) γ GRAIN SIZE (μm)
(10) ROLLING END TEMPERATURE (° C.)
(11) TIME(SEC) UNTIL START OF FINISH ROLLING
(12) ROLLING START TEMPERATURE (° C.)
(13) TOTAL ROLLING REDUCTION (%)
(14) NUMBER OF PASSES AT ROLLING REDUCTION OF 30% OR HIGHER
(15) MAXIMUM TEMPERATURE INCREASE (° C.) BETWEEN PASSES

TABLE 5

| | STEEL NO. | METALLURGICAL FACTORS (1) | (2) | (3) | (4) | T1 (° C.) | PRODUCTION CONDITIONS: HEATING TEMPERATURE CONDITIONS (5) | (6) | FIRST HOT ROLLING (7) | (8) | (9) | (10) | (11) | SECOND HOT ROLLING (12) | (13) | Tf (° C.) | P1 (%) | (14) | (15) |
|---|---|---|---|---|---|---|---|---|---|---|---|---|---|---|---|---|---|---|---|
| STEEL FOR COMPARISON | 61 | D | 1137 | 720 | 570 | 887 | 1230 | 45 | 1 | 50 | 140 | 1050 | 60 | 1040 | 93 | 980 | 35 | 2 | 15 |
| STEEL ACCORDING TO PRESENT INVENTION | 62 | C | 1101 | 798 | 648 | 896 | 1200 | 60 | 3 | 40/40/40 | 70 | 1100 | 90 | 1050 | 89 | 990 | 32 | 3 | 12 |
| STEEL ACCORDING TO PRESENT INVENTION | 63 | E | 1094 | 779 | 629 | 875 | 1200 | 60 | 3 | 40/40/40 | 70 | 1100 | 90 | 1030 | 89 | 970 | 32 | 3 | 12 |
| STEEL ACCORDING TO PRESENT INVENTION | 64 | F | 981 | 833 | 683 | 866 | 1200 | 60 | 3 | 40/40/40 | 70 | 1100 | 90 | 1020 | 89 | 960 | 32 | 3 | 12 |
| STEEL FOR COMPARISON | 65 | G | — | 825 | 675 | 851 | 1200 | 60 | 3 | 40/40/40 | 70 | 1100 | 90 | 1010 | 89 | 950 | 32 | 3 | 12 |
| STEEL FOR COMPARISON | 66 | H | 1100 | 813 | 663 | 858 | 1200 | 60 | 3 | 40/40/40 | 70 | 1100 | 90 | 1010 | 89 | 950 | 32 | 3 | 12 |
| STEEL ACCORDING TO PRESENT INVENTION | 67 | I | 1024 | 751 | 601 | 876 | 1200 | 60 | 3 | 40/40/40 | 70 | 1100 | 90 | 1020 | 89 | 960 | 32 | 3 | 12 |
| STEEL FOR COMPARISON | 68 | J | 764 | 699 | 549 | 865 | 1200 | 60 | 3 | 40/40/40 | 70 | 1100 | 90 | 1010 | 89 | 950 | 32 | 3 | 12 |
| STEEL FOR COMPARISON | 69 | K | — | 800 | 650 | 852 | 1200 | 60 | 3 | 40/40/40 | 70 | 1100 | 90 | 1000 | 89 | 940 | 32 | 3 | 12 |
| STEEL FOR COMPARISON | 70 | L | 1225 | 730 | 580 | 909 | 1230 | 60 | 3 | 40/40/40 | 70 | 1100 | 90 | 1050 | 89 | 990 | 32 | 3 | 12 |
| STEEL FOR COMPARISON | 71 | M | 1177 | 648 | 498 | 924 | 1230 | 60 | 3 | 40/40/40 | 70 | 1100 | 90 | 1050 | 89 | 990 | 32 | 3 | 12 |
| STEEL ACCORDING TO PRESENT INVENTION | 72 | N | 1129 | 716 | 566 | 885 | 1230 | 60 | 3 | 40/40/40 | 70 | 1100 | 90 | 1030 | 89 | 970 | 32 | 3 | 12 |
| STEEL ACCORDING TO PRESENT INVENTION | 73 | 0 | 1099 | 806 | 656 | 894 | 1230 | 60 | 3 | 40/40/40 | 70 | 1100 | 90 | 1040 | 89 | 980 | 32 | 3 | 12 |
| STEEL ACCORDING TO | 74 | P | 1092 | 745 | 595 | 924 | 1230 | 60 | 3 | 40/40/40 | 70 | 1100 | 90 | 1050 | 89 | 990 | 32 | 3 | 12 |

TABLE 5-continued

| | STEEL NO. | METALLURGICAL FACTORS (1) | (2) | (3) | (4) | T1 (° C.) | PRODUCTION CONDITIONS: HEATING TEMPERATURE CONDITIONS (5) | (6) | FIRST HOT ROLLING (7) | (8) | (9) | (10) | (11) | SECOND HOT ROLLING (12) | (13) | Tf (° C.) | P1 (%) | (14) | (15) |
|---|---|---|---|---|---|---|---|---|---|---|---|---|---|---|---|---|---|---|---|
| PRESENT INVENTION STEEL ACCORDING TO PRESENT INVENTION | 75 | Q | 1186 | 721 | 571 | 903 | 1230 | 35 | 3 | 40/40/40 | 70 | 1100 | 90 | 1050 | 89 | 990 | 32 | 3 | 12 |
| PRESENT INVENTION STEEL ACCORDING TO PRESENT INVENTION | 76 | R | 968 | 763 | 613 | 876 | 1230 | 60 | 3 | 40/40/40 | 70 | 1100 | 140 | 1040 | 89 | 980 | 32 | 3 | 12 |
| PRESENT INVENTION STEEL ACCORDING TO PRESENT INVENTION | 77 | S | 1193 | 676 | 526 | 900 | 1250 | 40 | 2 | 45/45 | 90 | 1075 | 120 | 1030 | 55 | 970 | 45 | 2 | 10 |
| PRESENT INVENTION STEEL ACCORDING TO PRESENT INVENTION | 78 | T | 933 | 871 | 721 | 855 | 1250 | 40 | 2 | 45/45 | 90 | 1075 | 120 | 1030 | 70 | 970 | 45 | 2 | 10 |
| STEEL FOR COMPARISON | 79 | T | 933 | 871 | 721 | 855 | 1250 | 40 | 2 | 45/45 | 90 | 1075 | 120 | 1030 | 70 | 970 | 45 | 2 | 10 |
| STEEL FOR COMPARISON | 80 | U | 875 | 769 | 619 | 853 | 1250 | 40 | 2 | 45/45 | 90 | 1075 | 120 | 1030 | 70 | 970 | 45 | 2 | 10 |
| STEEL FOR COMPARISON | 81 | V | 1134 | 833 | 683 | 893 | 1250 | 40 | 2 | 45/45 | 90 | 1075 | 120 | 1030 | 70 | 970 | 45 | 2 | 10 |
| STEEL FOR COMPARISON | 82 | W | 888 | 833 | 683 | 855 | 1250 | 40 | 2 | 45/45 | 90 | 1075 | 120 | 1030 | 70 | 970 | 45 | 2 | 10 |

(1) COMPONENT
(2) SOLUTION TEMPERATURE (° C.)
(3) Ar3 TRANSFORMATION TEMPERATURE (° C.)
(4) Ar1 TRANSFORMATION TEMPERATURE (° C.)
(5) HEATING TEMPERATURE (° C.)
(6) RETENTION TIME (MIN)
(7) NUMBER OF ROLLING OF 40% OR HIGHER AT 1000° C. OR HIGHER
(8) ROLLING REDUCTION (%) OF 40% OR HIGHER AT 1000° C. OR HIGHER (%)
(9) γ GRAIN SIZE (μm)
(10) ROLLING END TEMPERATURE (° C.)
(11) TIME (SEC) UNTIL START OF FINISH ROLLING
(12) ROLLING START TEMPERATURE (° C.)
(13) TOTAL ROLLING REDUCTION (%)
(14) NUMBER OF PASSES AT ROLLING REDUCTION OF 30% OR HIGHER
(15) MAXIMUM TEMPERATURE INCREASE (° C.) BETWEEN PASSES

TABLE 6

| | PRODUCTION CONDITIONS | | | | | | | | | | | | | |
|---|---|---|---|---|---|---|---|---|---|---|---|---|---|---|
| | THIRD HOT ROLLING | ROLLING END | COOLING CONDITIONS | | | | | | | | | | | |
| STEEL NO. | TOTAL ROLLING REDUCTION (%) | TEMPERATURE (° C.) | t1 (SEC) | 2.5 × t1 | (1) | t/t1 | (2) | (3) | (4) | (5) | (6) | (7) | (8) | (9) |
| 1 | 0 | 890 | 0.40 | 1.00 | 0.3 | 0.75 | 60 | 90 | 900 | 1.5 | 30 | — | — | 570 |
| 2 | 0 | 890 | 0.51 | 1.28 | 0.5 | 0.98 | 60 | 90 | 900 | 1.5 | 30 | — | — | 630 |
| 3 | 0 | 860 | 0.62 | 1.55 | 0.6 | 0.97 | 65 | 110 | 870 | 1.0 | 40 | — | — | 600 |
| 4 | 0 | 810 | 1.70 | 4.25 | 1.0 | 0.59 | 65 | 110 | 820 | 1.0 | 40 | — | — | 600 |
| 5 | 0 | 850 | 0.79 | 1.98 | 0.7 | 0.89 | 65 | 110 | 860 | 1.0 | 40 | — | — | 600 |
| 6 | 0 | 860 | 0.62 | 1.55 | 0.6 | 0.97 | 65 | 110 | 870 | 1.0 | 40 | — | — | 600 |
| 7 | 0 | 830 | 1.19 | 2.98 | 1.0 | 0.84 | 65 | 110 | 840 | 1.0 | 40 | — | — | 600 |
| 8 | 0 | 860 | 0.62 | 1.55 | 0.6 | 0.97 | 65 | 110 | 870 | 1.0 | 40 | — | — | 600 |
| 9 | 0 | 730 | 4.70 | 11.75 | 3.0 | 0.64 | 65 | 110 | 740 | 1.0 | 40 | — | — | 600 |
| 10 | 0 | 930 | 0.14 | 0.35 | 0.8 | 5.71 | 65 | 110 | 940 | 1.0 | 40 | — | — | 600 |
| 11 | 0 | 860 | — | — | 0.8 | — | 65 | 110 | 870 | 1.0 | 40 | — | — | 600 |
| 12 | 0 | 860 | 0.62 | 1.55 | 0.6 | 0.97 | 65 | 110 | 870 | 1.0 | 40 | — | — | 600 |
| 13 | 0 | 860 | 0.62 | 1.55 | 0.6 | 0.97 | 65 | 110 | 870 | 1.0 | 40 | — | — | 600 |
| 14 | 0 | 860 | 0.62 | 1.55 | 0.6 | 0.97 | 5 | 110 | 870 | 1.0 | 40 | — | — | 600 |
| 15 | 0 | 950 | 0.62 | 1.55 | 0.6 | 0.97 | 65 | 20 | 960 | 1.0 | 40 | — | — | 600 |
| 16 | 0 | 765 | 0.62 | 1.55 | 0.6 | 0.97 | 65 | 205 | 775 | 1.0 | 40 | — | — | 600 |
| 17 | 0 | 860 | 0.62 | 1.55 | 0.6 | 0.97 | 65 | 110 | 870 | 10.0 | 40 | — | — | 600 |
| 18 | 0 | 860 | 0.62 | 1.55 | 0.6 | 0.97 | 65 | 110 | 870 | 1.0 | 5 | — | — | 600 |
| 19 | 0 | 860 | 0.62 | 1.55 | 0.6 | 0.97 | 65 | 110 | 870 | 1.0 | 40 | — | — | 500 |
| 20 | 0 | 860 | 0.62 | 1.55 | 0.6 | 0.97 | 65 | 110 | 870 | 1.0 | 40 | — | — | 700 |

(1) TIME t (SEC) UNTIL START OF PRIMARY COOLING
(2) PRIMARY COOLING RATE (° C./SEC)
(3) PRIMARY COOLING TEMPERATURE CHANGE (° C.)
(4) PRIMARY COOLING END TEMPERATURE (° C.)
(5) TIME (SEC) UNTIL START OF SECONDARY COOLING
(6) SECONDARY COOLING RATE (° C./SEC)
(7) AIR COOLING TEMPERATURE RANGE (° C.)
(8) AIR COOLING RETENTION TIME (SEC)
(9) COILING TEMPERATURE (° C.)

TABLE 7

| | PRODUCTION CONDITIONS | | | | | | | | | | | | | |
|---|---|---|---|---|---|---|---|---|---|---|---|---|---|---|
| | THIRD HOT ROLLING | ROLLING END | COOLING CONDITIONS | | | | | | | | | | | |
| STEEL NO. | TOTAL ROLLING REDUCTION (%) | TEMPERATURE (° C.) | t1 (SEC) | 2.5 × t1 | (1) | t/t1 | (2) | (3) | (4) | (5) | (6) | (7) | (8) | (9) |
| 21 | 0 | 910 | 0.73 | 1.83 | 0.7 | 0.96 | 60 | 70 | 920 | 1.6 | 25 | 680 | 5 | 560 |
| 22 | 0 | 890 | 0.71 | 1.78 | 0.7 | 0.99 | 60 | 70 | 900 | 1.6 | 25 | — | — | 600 |
| 23 | 0 | 880 | 0.72 | 1.80 | 0.7 | 0.97 | 60 | 70 | 890 | 1.6 | 25 | — | — | 560 |
| 24 | 0 | 870 | 0.65 | 1.63 | 0.6 | 0.92 | 60 | 70 | 880 | 1.6 | 25 | — | — | 570 |
| 25 | 0 | 870 | 0.75 | 1.88 | 0.7 | 0.93 | 60 | 70 | 880 | 1.6 | 25 | — | — | 570 |
| 26 | 0 | 880 | 0.89 | 2.23 | 0.8 | 0.90 | 60 | 70 | 890 | 1.6 | 25 | — | — | 600 |
| 27 | 0 | 870 | 0.88 | 2.20 | 0.8 | 0.91 | 60 | 70 | 880 | 1.6 | 25 | — | — | 600 |
| 28 | 0 | 860 | 0.82 | 2.05 | 0.8 | 0.98 | 60 | 70 | 870 | 1.6 | 25 | — | — | 600 |
| 29 | 0 | 910 | 0.95 | 2.38 | 0.9 | 0.95 | 60 | 70 | 920 | 1.6 | 25 | — | — | 600 |
| 30 | 0 | 910 | 1.25 | 3.13 | 1.0 | 0.80 | 60 | 70 | 920 | 1.6 | 25 | — | — | 600 |
| 31 | 0 | 830 | 0.88 | 2.20 | 0.8 | 0.91 | 70 | 130 | 840 | 1.2 | 20 | — | — | 600 |
| 32 | 0 | 840 | 0.87 | 2.18 | 0.8 | 0.92 | 70 | 130 | 850 | 1.2 | 45 | 700 | 3 | 600 |
| 33 | 0 | 850 | 1.24 | 3.10 | 1.0 | 0.81 | 70 | 130 | 860 | 1.2 | 45 | — | — | 650 |
| 34 | 0 | 850 | 0.84 | 2.10 | 0.8 | 0.95 | 70 | 130 | 860 | 1.2 | 45 | — | — | 600 |
| 35 | 0 | 840 | 0.58 | 1.45 | 0.5 | 0.86 | 70 | 130 | 850 | 1.2 | 45 | — | — | 600 |
| 36 | 25 | 910 | 0.65 | 1.63 | 0.5 | 0.77 | 85 | 50 | 920 | 2.8 | 20 | — | — | 580 |
| 37 | 7 | 960 | 0.14 | 0.34 | 0.1 | 0.87 | 85 | 40 | 930 | 2.8 | 20 | — | — | 580 |
| 38 | 35 | 910 | 0.14 | 0.34 | 0.1 | 0.87 | 85 | 50 | 920 | 2.8 | 20 | — | — | 580 |
| 39 | 15 | 910 | 0.13 | 0.33 | 0.1 | 0.90 | 85 | 50 | 920 | 2.8 | 20 | — | — | 580 |
| 40 | 15 | 910 | 0.52 | 1.31 | 0.4 | 0.76 | 85 | 50 | 920 | 2.8 | 20 | — | — | 580 |

(1) TIME t (SEC) UNTIL START OF PRIMARY COOLING
(2) PRIMARY COOLING RATE (° C./SEC)
(3) PRIMARY COOLING TEMPERATURE CHANGE (° C.)
(4) PRIMARY COOLING END TEMPERATURE (° C.)
(5) TIME (SEC) UNTIL START OF SECONDARY COOLING
(6) SECONDARY COOLING RATE (° C./SEC)
(7) AIR COOLING TEMPERATURE RANGE (° C.)
(8) AIR COOLING RETENTION TIME (SEC)
(9) COILING TEMPERATURE (° C.)

TABLE 8

| | PRODUCTION CONDITIONS | | | | | | | | | | | | | |
|---|---|---|---|---|---|---|---|---|---|---|---|---|---|---|
| | THIRD HOT ROLLING | ROLLING END | COOLING CONDITIONS | | | | | | | | | | | |
| STEEL NO. | TOTAL ROLLING REDUCTION (%) | TEMPERATURE (° C.) | t1 (SEC) | 2.5 × t1 | (1) | t/t1 | (2) | (3) | (4) | (5) | (6) | (7) | (8) | (9) |
| 41 | 15 | 910 | 0.14 | 0.34 | 0.1 | 0.88 | 85 | 50 | 920 | 2.8 | 20 | — | — | 580 |
| 42 | 0 | 890 | 0.40 | 1.00 | 1.0 | 2.50 | 60 | 90 | 900 | 1.5 | 30 | — | — | 570 |
| 43 | 0 | 890 | 0.51 | 1.28 | 1.0 | 1.96 | 60 | 90 | 900 | 1.5 | 30 | — | — | 630 |
| 44 | 0 | 860 | 0.62 | 1.55 | 1.0 | 1.61 | 65 | 110 | 870 | 1.0 | 40 | — | — | 600 |
| 45 | 0 | 810 | 1.70 | 4.25 | 2.0 | 1.18 | 65 | 110 | 820 | 1.0 | 40 | — | — | 600 |
| 46 | 0 | 850 | 0.79 | 1.98 | 1.0 | 1.27 | 65 | 110 | 860 | 1.0 | 40 | — | — | 600 |
| 47 | 0 | 860 | 0.62 | 1.55 | 1.0 | 1.61 | 65 | 110 | 870 | 1.0 | 40 | — | — | 600 |
| 48 | 0 | 830 | 1.19 | 2.98 | 2.0 | 1.68 | 65 | 110 | 840 | 1.0 | 40 | — | — | 600 |
| 49 | 0 | 860 | 0.62 | 1.55 | 1.0 | 1.61 | 65 | 110 | 870 | 1.0 | 40 | — | — | 600 |
| 50 | 0 | 730 | 4.70 | 11.75 | 5.0 | 1.06 | 65 | 110 | 740 | 1.0 | 40 | — | — | 600 |
| 51 | 0 | 930 | 0.14 | 0.35 | 1.0 | 7.14 | 65 | 110 | 940 | 1.0 | 40 | — | — | 600 |
| 52 | 0 | 860 | — | — | 1.0 | — | 65 | 110 | 870 | 1.0 | 40 | — | — | 600 |
| 53 | 0 | 860 | 0.62 | 1.55 | 1.0 | 1.61 | 65 | 110 | 870 | 1.0 | 40 | — | — | 600 |
| 54 | 0 | 860 | 0.62 | 1.55 | 7.0 | 11.29 | 65 | 110 | 870 | 1.0 | 40 | — | — | 600 |
| 55 | 0 | 860 | 0.62 | 1.55 | 1.0 | 1.61 | 5 | 110 | 870 | 1.0 | 40 | — | — | 600 |
| 56 | 0 | 950 | 0.62 | 1.55 | 1.0 | 1.61 | 65 | 20 | 960 | 1.0 | 40 | — | — | 600 |
| 57 | 0 | 765 | 0.62 | 1.55 | 1.0 | 1.61 | 65 | 205 | 775 | 1.0 | 40 | — | — | 600 |
| 58 | 0 | 860 | 0.62 | 1.55 | 1.0 | 1.61 | 65 | 110 | 870 | 10.0 | 40 | — | — | 600 |
| 59 | 0 | 860 | 0.62 | 1.55 | 1.0 | 1.61 | 65 | 110 | 870 | 1.0 | 5 | — | — | 600 |
| 60 | 0 | 860 | 0.62 | 1.55 | 1.0 | 1.61 | 65 | 110 | 870 | 1.0 | 40 | — | — | 500 |

(1) TIME t (SEC) UNTIL START OF PRIMARY COOLING
(2) PRIMARY COOLING RATE (° C./SEC)
(3) PRIMARY COOLING TEMPERATURE CHANGE (° C.)
(4) PRIMARY COOLING END TEMPERATURE (° C.)
(5) TIME (SEC) UNTIL START OF SECONDARY COOLING
(6) SECONDARY COOLING RATE (° C./SEC)
(7) AIR COOLING TEMPERATURE RANGE (° C.)
(8) AIR COOLING RETENTION TIME (SEC)
(9) COILING TEMPERATURE (° C.)

TABLE 9

| | PRODUCTION CONDITIONS | | | | | | | | | | | | | |
|---|---|---|---|---|---|---|---|---|---|---|---|---|---|---|
| | THIRD HOT ROLLING | ROLLING END | COOLING CONDITIONS | | | | | | | | | | | |
| STEEL NO. | TOTAL ROLLING REDUCTION (%) | TEMPERATURE (° C.) | t1 (SEC) | 2.5 × t1 | (1) | t/t1 | (2) | (3) | (4) | (5) | (6) | (7) | (8) | (9) |
| 61 | 0 | 860 | 0.62 | 1.55 | 1.0 | 1.61 | 65 | 110 | 870 | 1.0 | 40 | — | — | 700 |
| 62 | 0 | 910 | 0.73 | 1.83 | 1.0 | 1.37 | 60 | 70 | 920 | 1.6 | 25 | 680 | 5 | 560 |
| 63 | 0 | 890 | 0.71 | 1.78 | 1.0 | 1.41 | 60 | 70 | 900 | 1.6 | 25 | — | — | 600 |
| 64 | 0 | 880 | 0.72 | 1.80 | 1.0 | 1.39 | 60 | 70 | 890 | 1.6 | 25 | — | — | 560 |
| 65 | 0 | 870 | 0.65 | 1.63 | 1.0 | 1.54 | 60 | 70 | 880 | 1.6 | 25 | — | — | 570 |
| 66 | 0 | 870 | 0.75 | 1.88 | 1.0 | 1.33 | 60 | 70 | 880 | 1.6 | 25 | — | — | 570 |
| 67 | 0 | 880 | 0.89 | 2.23 | 1.0 | 1.12 | 60 | 70 | 890 | 1.6 | 25 | — | — | 600 |
| 68 | 0 | 870 | 0.88 | 2.20 | 1.0 | 1.14 | 60 | 70 | 880 | 1.6 | 25 | — | — | 600 |
| 69 | 0 | 860 | 0.82 | 2.05 | 1.0 | 1.22 | 60 | 70 | 870 | 1.6 | 25 | — | — | 600 |
| 70 | 28 | 900 | 0.95 | 2.38 | 1.0 | 1.05 | 60 | 70 | 920 | 1.6 | 25 | — | — | 600 |
| 71 | 0 | 910 | 1.25 | 3.13 | 3.0 | 2.40 | 60 | 70 | 920 | 1.6 | 25 | — | — | 600 |
| 72 | 0 | 830 | 0.88 | 2.20 | 2.0 | 2.27 | 55 | 130 | 840 | 1.2 | 45 | — | — | 600 |
| 73 | 0 | 840 | 0.87 | 2.18 | 2.0 | 2.30 | 70 | 130 | 850 | 1.2 | 45 | 700 | 3 | 600 |
| 74 | 0 | 850 | 1.24 | 3.10 | 2.0 | 1.61 | 70 | 130 | 860 | 2.8 | 45 | — | — | 600 |
| 75 | 0 | 850 | 0.84 | 2.10 | 2.0 | 2.38 | 70 | 130 | 860 | 1.2 | 45 | — | — | 600 |
| 76 | 0 | 840 | 0.58 | 1.45 | 1.0 | 1.72 | 70 | 130 | 850 | 1.2 | 45 | — | — | 600 |
| 77 | 25 | 910 | 0.65 | 1.63 | 1.5 | 2.31 | 80 | 50 | 920 | 2.8 | 20 | — | — | 580 |
| 78 | 7 | 960 | 0.14 | 0.34 | 0.3 | 2.18 | 80 | 40 | 930 | 2.8 | 20 | — | — | 580 |
| 79 | 35 | 910 | 0.14 | 0.34 | 0.4 | 2.91 | 80 | 50 | 920 | 2.8 | 20 | — | — | 580 |
| 80 | 15 | 910 | 0.13 | 0.33 | 0.3 | 2.25 | 80 | 50 | 920 | 2.8 | 20 | — | — | 580 |

TABLE 9-continued

| | PRODUCTION CONDITIONS | | | | | | | | | | | | | | |
|---|---|---|---|---|---|---|---|---|---|---|---|---|---|---|---|
| | THIRD HOT ROLLING | | ROLLING END | COOLING CONDITIONS | | | | | | | | | | | |
| STEEL NO. | TOTAL ROLLING REDUCTION (%) | | TEMPERATURE (° C.) | t1 (SEC) | 2.5 × t1 | (1) | t/t1 | (2) | (3) | (4) | (5) | (6) | (7) | (8) | (9) |
| 81 | 15 | | 910 | 0.52 | 1.31 | 1.0 | 1.91 | 80 | 50 | 920 | 2.8 | 20 | — | — | 580 |
| 82 | 15 | | 910 | 0.14 | 0.34 | 0.3 | 2.20 | 80 | 50 | 920 | 2.8 | 20 | — | — | 580 |

(1) TIME t (SEC) UNTIL START OF PRIMARY COOLING
(2) PRIMARY COOLING RATE (° C./SEC)
(3) PRIMARY COOLING TEMPERATURE CHANGE (° C.)
(4) PRIMARY COOLING END TEMPERATURE (° C.)
(5) TIME (SEC) UNTIL START OF SECONDARY COOLING
(6) SECONDARY COOLING RATE (° C./SEC)
(7) AIR COOLING TEMPERATURE RANGE (° C.)
(8) AIR COOLING RETENTION TIME (SEC)
(9) COILING TEMPERATURE (° C.)

In Table 1, the expression (a) is expressed by ([Ti]−[N]×48/14−[S]×48/32); the expression (b) is expressed by [C]−12/48×([Ti]−[N]×48/14−[S]×48/32); and the expression (c) is expressed by [C]−12/48×([Ti]+[Nb]×48/93−[N]×48/14−[S]×48/32).

In Tables 2 to 9, "Component" represents the symbol of the steel shown in Table 1; "Solution Temperature" represents the minimum slab reheating temperature calculated according to the expression (d); "Ar3 Transformation Temperature" represents the temperature calculated according to the expression (j), (k), or (l); "T1" represents the temperature calculated according to the expression (e); and "t1" represents the time calculated according to the expression (g)

"Heating Temperature" represents the heating temperature in the heating process; and "Retention Time" represents the retention time at the predetermined heating temperature in the heating process.

"Number of Rolling of 40% or Higher at 1000° C. or Higher" represents the number of rolling at a rolling reduction of 40% or higher at 1000° C. or higher during rough rolling; "Rolling Reduction of 40% or Higher at 1000° C. or Higher" represents the rolling reduction of 40% or higher at 1000° C. or higher during rough rolling; "Time Until Start of Finish Rolling" represents the time from the finish of rough rolling to the start of finish rolling; "Total Rolling Reduction" of each of second hot rolling and third hot rolling represents the total rolling reduction in each hot rolling process.

"Tr" represents the temperature after final rolling of a large reduction of 30% or higher; "P1" represents the rolling reduction of a final pass of a large reduction of 30% or higher; and "Maximum Temperature Increase between Passes" represents the maximum temperature which is increased by deformation heating between passes of the second hot rolling process.

"Time Until Start of Primary Cooling" represents the time from the finish of a final pass of a large reduction pass to the start of primary cooling; "Primary Cooling Rate" represents the average cooling rate from the finish of finish rolling to the finish of cooling corresponding to the primary cooling temperature change; and "Primary Cooling Temperature Change" represents the difference between the start temperature and the end temperature of primary cooling.

"Time Until Start of Secondary Cooling" represents the time from the finish of primary cooling to the start of secondary cooling; and "Secondary Cooling Rate" represents the average cooling rate from the start of secondary cooling to the end of secondary cooling. In this case, when the retention is performed during secondary cooling, the retention time is excluded. "Air Cooling Temperature Range" represents the temperature range which is retained during secondary cooling or after the finish of secondary cooling; "Air cooling Retention Time" represents the retention time for which retention is performed; and "Coiling Temperature" represents the temperature at which the steel sheet is coiled around a coiler in the coiling process. When secondary cooling is performed at a run-out table, the coiling temperature is approximately the same as the end temperature of secondary cooling.

The evaluation methods of the obtained steel sheet are the same as the above-described methods. The evaluation results are shown in Tables 10 to 13. The underline value in the tables are out of the range of the present invention. Regarding the microstructure in the tables, F represents ferrite, P represents pearlite, and Zw represents a continuous cooling transformation structure.

TABLE 10

| | | | | | | | | MECHANICAL PROPERTIES | | | | | | |
|---|---|---|---|---|---|---|---|---|---|---|---|---|---|---|
| | | | | | | | | TENSILE TEST | | | | HOLE EXPANSIBILITY | FRACTURE SURFACE CRACKING | TOUGHNESS |
| STEEL | MICROSTRUCTURE | | | | | | | YP | TS | EI | ISOTROPY | λ | ○: NONE | vTrs |
| NO. | (1) | (2) | (3) | (4) | (5) | (6) | (7) | (MPa) | (MPa) | (%) | 1/\|Δr\| | (%) | X: CRACKED | (° C.) |
| 1 | Zw | 6.5 | 1.9 | 2.2 | 3.1 | 1.8 | $7 \times 10^{16}$ | 858 | 1014 | 13.0 | 5.4 | 71 | ○ | −80 |
| 2 | F + P | 7.0 | 2.9 | 2.2 | 3.1 | 4.4 | $9 \times 10^{15}$ | 768 | 931 | 14.8 | 5.4 | 48 | ○ | −60 |
| 3 | F + Zw | 7.0 | 1.6 | 2.3 | 3.2 | 1.4 | $3 \times 10^{16}$ | 745 | 816 | 19.7 | 5.0 | 91 | ○ | −68 |

TABLE 10-continued

| STEEL NO. | MICROSTRUCTURE (1) | (2) | (3) | (4) | (5) | (6) | (7) | MECHANICAL PROPERTIES: TENSILE TEST YP (MPa) | TS (MPa) | EI (%) | ISOTROPY 1/\|Δr\| | HOLE EXPANSIBILITY λ (%) | FRACTURE SURFACE CRACKING ○: NONE X: CRACKED | TOUGHNESS vTrs (° C.) |
|---|---|---|---|---|---|---|---|---|---|---|---|---|---|---|
| 4 | F + Zw | 6.0 | 1.7 | 4.0 | 4.7 | 2.0 | $9 \times 10^{14}$ | 478 | 533 | 27.8 | 3.5 | 70 | ○ | −93 |
| 5 | F + Zw | 5.5 | 1.6 | 2.5 | 3.4 | 1.7 | $1 \times 10^{16}$ | 610 | 780 | 20.7 | 4.5 | 94 | ○ | −108 |
| 6 | F + Zw | 10.5 | 1.9 | 2.3 | 3.2 | 1.6 | $2 \times 10^{16}$ | 716 | 803 | 20.1 | 5.0 | 92 | ○ | −18 |
| 7 | F + Zw | 11.0 | 1.9 | 3.6 | 4.4 | 1.4 | $2 \times 10^{16}$ | 710 | 805 | 20.4 | 3.5 | 95 | ○ | −5 |
| 8 | F + Zw | 7.5 | 1.7 | 4.2 | 5.0 | 1.4 | $1 \times 10^{16}$ | 755 | 820 | 18.2 | 3.2 | 46 | ○ | −93 |
| 9 | F + Zw | 3.5 | 1.5 | 5.6 | 5.6 | 1.8 | $2 \times 10^{16}$ | 714 | 788 | 19.7 | 3.0 | 35 | ○ | −197 |
| 10 | Zw | 11.0 | 1.5 | 2.2 | 3.1 | 1.8 | $7 \times 10^{16}$ | 772 | 846 | 17.9 | 5.4 | 94 | ○ | −5 |
| 11 | F + Zw | 12.0 | 1.6 | 5.8 | 5.7 | 1.4 | $4 \times 10^{16}$ | 751 | 828 | 18.5 | 3.0 | 45 | ○ | 0 |
| 12 | F + Zw | 7.0 | 1.6 | 2.2 | 3.1 | 3.0 | $6 \times 10^{16}$ | 746 | 830 | 18.8 | 5.4 | 88 | ○ | −67 |
| 13 | F + Zw | 6.0 | 1.6 | 2.2 | 3.1 | 2.7 | $1 \times 10^{16}$ | 786 | 850 | 17.8 | 5.4 | 100 | ○ | −90 |
| 14 | F + Zw | 11.5 | 1.9 | 2.3 | 3.2 | 1.7 | $7 \times 10^{16}$ | 766 | 844 | 18.0 | 5.0 | 98 | ○ | 0 |
| 15 | F + Zw | 10.5 | 1.9 | 2.3 | 3.2 | 1.5 | $6 \times 10^{16}$ | 755 | 833 | 19.0 | 5.0 | 80 | ○ | −17 |
| 16 | F + Zw | 5.5 | 1.6 | 5.9 | 5.7 | 3.0 | $7 \times 10^{16}$ | 720 | 791 | 20.2 | 3.0 | 50 | ○ | −108 |
| 17 | F + P | 11.0 | 3.0 | 2.2 | 3.1 | 4.7 | $1 \times 10^{16}$ | 612 | 706 | 22.0 | 5.4 | 66 | ○ | −5 |
| 18 | F + Zw | 8.0 | 2.0 | 2.3 | 3.2 | 5.5 | $5 \times 10^{14}$ | 484 | 538 | 28.0 | 5.0 | 102 | ○ | −48 |
| 19 | F + Zw | 7.0 | 2.2 | 2.3 | 3.2 | 1.2 | $1 \times 10^{15}$ | 622 | 768 | 22.0 | 5.0 | 67 | ○ | −68 |
| 20 | F + P | 8.5 | 3.2 | 2.2 | 3.1 | 6.3 | $1 \times 10^{14}$ | 599 | 688 | 23.0 | 5.4 | 63 | ○ | −18 |

(1) MICROSTRUCTURE
(2) AVERAGE GRAIN SIZE(μm)
(3) CEMENTITE GRAIN SIZE(μm)
(4) AVERAGE POLE DENSITY OF ORIENTATION GROUP {100}<011> TO {223}<110>
(5) POLE DENSITY OF CRYSTAL ORIENTATION {332}<113>
(6) TiC SIZE (nm)
(7) TiC DENSITY (GRAINS/$cm^3$)

TABLE 11

| STEEL NO. | MICROSTRUCTURE (1) | (2) | (3) | (4) | (5) | (6) | (7) | MECHANICAL PROPERTIES: TENSILE TEST YP (MPa) | TS (MPa) | EI (%) | ISOTROPY 1/\|Δr\| | HOLE EXPANSIBILITY λ (%) | FRACTURE SURFACE CRACKING ○: NONE X: CRACKED | TOUGHNESS vTrs (° C.) |
|---|---|---|---|---|---|---|---|---|---|---|---|---|---|---|
| 21 | F + Zw | 6.0 | 1.4 | 2.2 | 3.1 | 1.8 | $5 \times 10^{16}$ | 675 | 799 | 19.6 | 5.4 | 97 | ○ | −93 |
| 22 | Zw | 7.0 | 1.3 | 2.5 | 3.4 | 2.5 | $1 \times 10^{16}$ | 682 | 801 | 19.2 | 4.5 | 110 | ○ | −60 |
| 23 | F + Zw | 7.0 | 1.7 | 2.5 | 3.4 | 1.7 | $7 \times 10^{16}$ | 429 | 624 | 29.4 | 4.5 | 179 | ○ | −68 |
| 24 | F + P | 8.5 | 3.1 | 2.5 | 3.4 | — | 0 | 387 | 488 | 34.0 | 4.5 | 145 | ○ | −18 |
| 25 | F + P | 7.0 | 4.6 | 4.0 | 4.8 | 2.6 | $1 \times 10^{10}$ | 360 | 497 | 32.2 | 3.5 | 96 | ○ | −61 |
| 26 | F | 7.0 | 0.6 | 2.5 | 3.4 | 1.6 | $4 \times 10^{16}$ | 377 | 601 | 30.2 | 4.5 | 204 | ○ | −61 |
| 27 | F | 10.0 | — | 2.5 | 3.4 | 6.0 | $2 \times 10^{10}$ | 302 | 455 | 38.0 | 4.5 | 212 | X | −15 |
| 28 | F + P | 8.5 | 5.1 | 3.1 | 4.0 | — | 0 | 380 | 526 | 27.2 | 3.8 | 45 | ○ | −19 |
| 29 | F + Zw | 5.0 | 1.6 | 4.1 | 4.9 | 1.9 | $9 \times 10^{16}$ | 796 | 1089 | 10.5 | 3.3 | 19 | ○ | −125 |
| 30 | Zw | 4.5 | 1.9 | 6.0 | 5.7 | 2.0 | $1 \times 10^{16}$ | 821 | 1067 | 11.0 | 2.9 | 22 | ○ | −145 |
| 31 | F + Zw | 5.5 | 1.9 | 2.5 | 3.4 | 2.1 | $3 \times 10^{16}$ | 695 | 812 | 19.5 | 4.5 | 102 | ○ | −108 |
| 32 | F + Zw | 6.0 | 1.6 | 2.4 | 3.3 | 3.0 | $5 \times 10^{16}$ | 678 | 816 | 18.9 | 4.7 | 113 | ○ | −93 |
| 33 | F + Zw | 7.0 | 1.4 | 2.4 | 3.3 | 2.6 | $5 \times 10^{16}$ | 692 | 822 | 19.0 | 4.7 | 120 | ○ | −62 |
| 34 | Zw | 6.5 | 1.8 | 2.3 | 3.2 | 2.3 | $6 \times 10^{16}$ | 879 | 1025 | 13.4 | 5.0 | 70 | ○ | −80 |
| 35 | F + Zw | 7.0 | 1.7 | 2.3 | 3.2 | 1.8 | $2 \times 10^{16}$ | 477 | 631 | 28.8 | 5.0 | 168 | ○ | −64 |
| 36 | F + Zw | 7.0 | 1.6 | 3.4 | 4.2 | 2.0 | $9 \times 10^{16}$ | 761 | 846 | 17.7 | 3.6 | 89 | ○ | −62 |
| 37 | F + Zw | 5.0 | 1.7 | 3.9 | 4.6 | 2.2 | $1 \times 10^{16}$ | 750 | 833 | 18.0 | 3.5 | 90 | ○ | −125 |
| 38 | F + Zw | 6.0 | 1.8 | 5.0 | 5.6 | 2.3 | $1 \times 10^{16}$ | 720 | 800 | 18.8 | 2.9 | 51 | ○ | −93 |
| 39 | F + Zw | 5.5 | 1.9 | 3.7 | 4.5 | 3.1 | $1 \times 10^{14}$ | 480 | 533 | 28.1 | 3.5 | 70 | ○ | −108 |
| 40 | F + Zw | 6.0 | 0.7 | 3.5 | 4.3 | 1.8 | $6 \times 10^{16}$ | 730 | 811 | 18.5 | 3.5 | 70 | X | −93 |

(1) MICROSTRUCTURE
(2) AVERAGE GRAIN SIZE (μm)
(3) CEMENTITE GRAIN SIZE (μm)
(4) AVERAGE POLE DENSITY OF ORIENTATION GROUP {100}<011> TO {223}<110>
(5) POLE DENSITY OF CRYSTAL ORIENTATION {332}<113>
(6) TiC SIZE (nm)
(7) TiC DENSITY (GRAINS/$cm^3$)

TABLE 12

| STEEL NO. | MICROSTRUCTURE (1) | (2) | (3) | (4) | (5) | (6) | (7) | MECHANICAL PROPERTIES: TENSILE TEST YP (MPa) | TS (MPa) | EI (%) | ISOTROPY 1/\|Δr\| | HOLE EXPANSIBILITY λ (%) | FRACTURE SURFACE CRACKING ○: NONE X: CRACKED | TOUGHNESS vTrs (° C.) |
|---|---|---|---|---|---|---|---|---|---|---|---|---|---|---|
| 41 | F + Zw | 6.0 | 1.7 | 3.3 | 4.2 | 3.9 | $1 \times 10^{14}$ | 450 | 523 | 27.0 | 3.6 | 71 | ○ | −93 |
| 42 | Zw | 7.5 | 1.9 | 1.7 | 2.5 | 1.8 | $7 \times 10^{16}$ | 846 | 1000 | 13.2 | 12.5 | 77 | ○ | −58 |
| 43 | F + P | 8.0 | 2.9 | 1.7 | 2.5 | 4.4 | $9 \times 10^{15}$ | 756 | 916 | 15.0 | 12.5 | 48 | ○ | −48 |
| 44 | F + Zw | 8.0 | 1.5 | 1.8 | 2.6 | 1.4 | $3 \times 10^{16}$ | 733 | 803 | 20.0 | 9.2 | 91 | ○ | −48 |
| 45 | F + Zw | 7.0 | 1.7 | 2.0 | 3.0 | 2.0 | $9 \times 10^{14}$ | 470 | 524 | 22.8 | 6.0 | 70 | ○ | −68 |
| 46 | F + Zw | 6.5 | 1.4 | 2.0 | 2.9 | 1.7 | $1 \times 10^{16}$ | 598 | 765 | 29.0 | 6.5 | 94 | ○ | −80 |
| 47 | F + Zw | 10.5 | 1.9 | 1.7 | 2.5 | 1.6 | $2 \times 10^{16}$ | 704 | 790 | 20.4 | 12.5 | 92 | ○ | −11 |
| 48 | F + Zw | 11.0 | 1.9 | 2.0 | 3.0 | 1.4 | $2 \times 10^{16}$ | 698 | 791 | 20.8 | 6.3 | 95 | ○ | −5 |
| 49 | F + Zw | 12.0 | 1.7 | 4.1 | 4.7 | 1.4 | $1 \times 10^{16}$ | 743 | 807 | 18.5 | 3.3 | 46 | ○ | 6 |
| 50 | F + Zw | 4.5 | 1.5 | 5.1 | 5.5 | 1.8 | $2 \times 10^{16}$ | 702 | 775 | 20.0 | 3.1 | 35 | ○ | −120 |
| 51 | Zw | 11.0 | 1.5 | 1.7 | 2.5 | 1.8 | $7 \times 10^{16}$ | 760 | 833 | 18.2 | 12.5 | 94 | ○ | −5 |
| 52 | F + Zw | 11.0 | 1.6 | 5.3 | 5.6 | 1.4 | $4 \times 10^{16}$ | 739 | 815 | 18.8 | 3.0 | 45 | ○ | −10 |
| 53 | F + Zw | 10.0 | 1.6 | 1.7 | 2.5 | 3.0 | $6 \times 10^{16}$ | 734 | 817 | 19.1 | 12.5 | 88 | ○ | −24 |
| 54 | F + Zw | 12.0 | 1.9 | 1.7 | 2.5 | 2.7 | $1 \times 10^{16}$ | 774 | 837 | 18.1 | 12.5 | 100 | ○ | 0 |
| 55 | F + Zw | 11.5 | 1.9 | 1.8 | 2.6 | 1.7 | $7 \times 10^{16}$ | 754 | 831 | 18.3 | 9.2 | 98 | ○ | 0 |
| 56 | F + Zw | 11.0 | 1.9 | 1.8 | 2.6 | 1.5 | $6 \times 10^{16}$ | 743 | 820 | 19.3 | 9.2 | 80 | ○ | −7 |
| 57 | F + Zw | 6.5 | 1.6 | 5.4 | 5.7 | 2.8 | $7 \times 10^{16}$ | 708 | 778 | 20.5 | 3.0 | 50 | ○ | −80 |
| 58 | F + P | 12.0 | 3.0 | 1.7 | 2.5 | 4.7 | $1 \times 10^{16}$ | 600 | 692 | 22.4 | 12.5 | 66 | ○ | 0 |
| 59 | F + Zw | 8.0 | 2.0 | 1.8 | 2.6 | 5.5 | $5 \times 10^{14}$ | 475 | 528 | 28.4 | 9.2 | 102 | ○ | −48 |
| 60 | F + Zw | 8.0 | 2.2 | 1.8 | 2.6 | 1.2 | $1 \times 10^{15}$ | 610 | 753 | 22.4 | 9.2 | 67 | ○ | −48 |

(1) MICROSTRUCTURE
(2) AVERAGE GRAIN SIZE (μm)
(3) CEMENTITE GRAIN SIZE(μm)
(4) AVERAGE POLE DENSITY OF ORIENTATION GROUP {100}<011> TO {223}<110>
(5) POLE DENSITY OF CRYSTAL ORIENTATION {332}<113>
(6) TiC SIZE (nm)
(7) TiC DENSITY (GRAINS/$cm^3$)

TABLE 13

| STEEL NO. | MICROSTRUCTURE (1) | (2) | (3) | (4) | (5) | (6) | (7) | MECHANICAL PROPERTIES: TENSILE TEST YP (MPa) | TS (MPa) | EI (%) | ISO-TROPY 1/\|Δr\| | HOLE EXPANSIBILITY λ (%) | FRACTURE CRACKING ○: NONE X: CRACKED | SURFACE TOUGHNESS vTrs (° C.) |
|---|---|---|---|---|---|---|---|---|---|---|---|---|---|---|
| 61 | F + P | 10.0 | 3.2 | 1.7 | 2.5 | 6.3 | $1 \times 10^{14}$ | 587 | 674 | 23.5 | 12.5 | 66 | ○ | −19 |
| 62 | F + Zw | 7.0 | 1.4 | 1.7 | 2.5 | 1.8 | $5 \times 10^{16}$ | 663 | 785 | 20.0 | 12.5 | 97 | ○ | −68 |
| 63 | Zw | 9.0 | 1.3 | 2.0 | 2.9 | 2.5 | $1 \times 10^{16}$ | 670 | 787 | 19.5 | 6.5 | 110 | ○ | −40 |
| 64 | F + Zw | 8.0 | 1.7 | 2.0 | 2.9 | 1.7 | $7 \times 10^{16}$ | 417 | 607 | 30.2 | 6.5 | 179 | ○ | −75 |
| 65 | F + P | 10.0 | 3.1 | 2.0 | 2.9 | — | 0 | 375 | 473 | 35.1 | 6.5 | 145 | ○ | −19 |
| 66 | F + P | 10.0 | 4.6 | 1.9 | 2.8 | 3.7 | $1 \times 10^{10}$ | 348 | 480 | 33.3 | 7.0 | 96 | ○ | −17 |
| 67 | F | 8.5 | 0.6 | 2.0 | 2.9 | 1.6 | $4 \times 10^{16}$ | 365 | 582 | 31.2 | 6.5 | 204 | ○ | −41 |
| 68 | F | 14.0 | — | 2.0 | 2.9 | 6.0 | $2 \times 10^{10}$ | 290 | 437 | 39.6 | 6.5 | 212 | X | 21 |
| 69 | F + P | 9.5 | 5.1 | 2.0 | 3.0 | — | 0 | 368 | 509 | 28.1 | 6.4 | 45 | ○ | −10 |
| 70 | F + Zw | 6.0 | 1.6 | 4.1 | 4.9 | 3.0 | $9 \times 10^{16}$ | 784 | 1073 | 10.7 | 3.2 | 19 | ○ | −93 |
| 71 | Zw | 5.5 | 1.9 | 5.5 | 5.7 | 2.0 | $1 \times 10^{16}$ | 809 | 1051 | 11.2 | 3.0 | 22 | ○ | −108 |
| 72 | F + Zw | 6.5 | 1.9 | 2.0 | 2.9 | 2.1 | $3 \times 10^{16}$ | 683 | 798 | 19.8 | 6.5 | 102 | ○ | −80 |
| 73 | F + Zw | 7.0 | 1.6 | 1.9 | 2.8 | 3.0 | $5 \times 10^{16}$ | 666 | 802 | 19.2 | 7.5 | 113 | ○ | −68 |
| 74 | F + Zw | 8.5 | 1.4 | 1.9 | 2.8 | 2.6 | $5 \times 10^{16}$ | 680 | 808 | 19.3 | 7.5 | 120 | ○ | −45 |
| 75 | Zw | 7.5 | 1.8 | 1.8 | 2.6 | 2.3 | $6 \times 10^{16}$ | 867 | 1011 | 13.6 | 9.2 | 70 | ○ | −58 |
| 76 | F + Zw | 8.5 | 1.7 | 1.8 | 2.6 | 1.8 | $2 \times 10^{16}$ | 465 | 615 | 29.5 | 9.2 | 168 | ○ | −80 |
| 77 | F + Zw | 10.0 | 1.6 | 1.9 | 2.7 | 2.0 | $9 \times 10^{16}$ | 769 | 854 | 17.6 | 7.5 | 122 | ○ | −21 |
| 78 | F + Zw | 7.0 | 1.7 | 2.0 | 2.9 | 2.2 | $1 \times 10^{16}$ | 739 | 821 | 18.3 | 6.5 | 88 | ○ | −59 |
| 79 | F + Zw | 15.0 | 1.8 | 4.1 | 4.9 | 2.3 | $1 \times 10^{16}$ | 716 | 796 | 18.8 | 3.3 | 91 | ○ | 31 |
| 80 | F + Zw | 7.5 | 1.9 | 2.0 | 3.0 | 3.1 | $1 \times 10^{14}$ | 475 | 528 | 28.4 | 6.2 | 70 | ○ | −58 |

TABLE 13-continued

| STEEL NO. | MICROSTRUCTURE (1) | (2) | (3) | (4) | (5) | (6) | (7) | MECHANICAL PROPERTIES: TENSILE TEST YP (MPa) | TS (MPa) | EI (%) | ISO-TROPY 1/\|Δr\| | HOLE EXPANSIBILITY λ (%) | FRACTURE CRACKING ○: NONE X: CRACKED | SURFACE TOUGHNESS vTrs (° C.) |
|---|---|---|---|---|---|---|---|---|---|---|---|---|---|---|
| 81 | F + Zw | 8.0 | 0.7 | 2.0 | 2.9 | 1.8 | $6 \times 10^{16}$ | 723 | 803 | 18.7 | 6.5 | 142 | X | −48 |
| 82 | F + Zw | 8.0 | 1.7 | 1.8 | 2.6 | 3.4 | $1 \times 10^{13}$ | 457 | 508 | 28.0 | 9.2 | 76 | ○ | −48 |

(1) MICROSTRUCTURE
(2) AVERAGE GRAIN SIZE (μm)
(3) CEMENTITE GRAIN SIZE (μm)
(4) AVERAGE POLE DENSITY OF ORIENTATION GROUP {100}<011> TO {223}<110>
(5) POLE DENSITY OF CRYSTAL ORIENTATION {332}<113>
(6) TiC SIZE (nm)
(7) TiC DENSITY (GRAINS/$cm^3$)

"Microstructure" represents the optical microscopic structure; "Average Grain Size" represents the average grain size measured using EBSP-OIM (registered trademark); and "Cementite Grain Size" represents the average grain size of cementite precipitating in a grain boundary.

"Average Pole Density of Orientation Group {100}<011> to {223}<110>" and "Pole Density of Crystal Orientation {332}<113>" represent the above-described pole densities.

"TiC Size" represents the average precipitate size of TiC (which may contain Nb and a small content of N) measured using 3D-AP (3-dimensional Atom Probe); and "TiC Density" represents the average number of TiC per unit volume measured using 3D-AP.

"Tensile Test" represents the result of the tensile test using JIS No. 5 test piece in the C direction. "YP" represents yield point; "TS" represents tensile strength; and the "El" represents elongation.

"Isotropy" represents the inverse of |Δr| as the index. "Hole Expansibility" represents the results of the hole expansibility test method according to JFS T 1001-1996. "Fracture Surface Cracking" represents the results of observing whether or not fracture surface cracking occurred by visual inspection. Cases where fracture surface cracking did not occur are represented by "None"; and cases where fracture surface cracking occurred are represented by "Cracked" "Toughness" represents the transition temperature (vTrs) obtained in the sub-size V-notch Charpy impact test.

According to the examples according to the present invention, a high-strength steel sheet having a strength of 540 MPa grade or higher was obtained in which, in the texture of the steel sheet having the predetermined chemical composition, the average pole density of the orientation group {100}<011> to {223}<110> was 1.0 to 4.0; the pole density of a crystal orientation {332}<113> was 1.0 to 4.8, in the thickness center portion which is a thickness range of ⅝ to ⅜ from the surface of the steel sheet; the average grain size in the thickness center portion was less than or equal to 10 μm; the grain size of cementite precipitating in a grain boundary of the steel sheet was less than or equal to 2 μm; the average grain size of precipitates containing TiC in grains was less than or equal to 3 nm; and the density of the precipitates was greater than or equal to $1\times10^{16}$ grains/$cm^3$. As a result, the results for hole expansibility were also superior at 70% or higher.

In the examples of steel sheet for comparison other than the above-described examples, as shown in Tables 1 to 9, the components or the production conditions were out of the range of the present invention. Therefore, as shown in Tables 10 to 13, "Microstructure" was out of the range of the present invention and thus, sufficient mechanical properties were not obtained. In "Cementite Grain Size" and "TiC size" of the tables, "-" represents cementite or TiC not being observed.

INDUSTRIAL APPLICABILITY

As described above, according to the present invention, it is possible to easily provide a steel sheet which can be applied to components (automobile components such as inner plate components, structural components, suspension components, and transmissions; and other components such as shipbuilding materials, construction materials, bridge materials, marine structures, pressure vessels, line pipes, and mechanical components) requiring workability such as hole expansibility or bendability, strict homogeneity in thickness and circularity after processing, and low-temperature toughness. In addition, according to the present invention, a high-strength steel sheet having superior low-temperature toughness and a strength of 540 MPa grade or higher can be stably produced at a low cost. Accordingly, the present invention has a high industrial value.

The invention claimed is:

1. A hot-rolled steel sheet comprising, by mass %,

C: a content [C] of 0.02% to 0.07%,

Si: a content [Si] of 0.001% to 2.5%,

Mn: a content [Mn] of 0.01% to 4%,

Al: a content [Al] of 0.001% to 2%,

Ti: a content [Ti] of 0.015% to 0.2%,

P: a limited content [P] of 0.15% or less,

S: a limited content [S] of 0.03% or less,

N: a limited content [N] of 0.01% or less, and the balance consisting of Fe and unavoidable impurities, wherein the contents [Ti], [N], [S], and [C] satisfy the following expressions (a) and (b);

an average pole density of an orientation group {100}<011> to {223}<110>, which is represented by an arithmetic mean of pole densities of orientations {100}<011>, {116}<110>, {114}<110>, {112}<110, and {223}<110> is 1.0 to 4.0 and a pole density of a crystal orientation {332}<113> is 1.0 to 4.8, in a thickness center portion which is a thickness range of ⅝ to ⅜ from the surface of the steel sheet;

an average grain size in the thickness center portion is less than or equal to 10 μm and a grain size of a cementite precipitating in a grain boundary in the steel sheet is less than or equal to 2 μm; and an average grain size of precipitates containing TiC in grains is less than or equal to 3 nm and a number density per unit volume is greater than or equal to $1\times10^{16}$ grains/$cm^3$, $$0\%\leq([Ti]-[N]\times48/14-[S]\times48/32) \quad (a)$$

$$0\%\leq[C]-12/48\times([Ti]-[N]\times48/14-[S]\times48/32) \quad (b).$$

2. The hot-rolled steel sheet according to claim 1, wherein the average pole density of the orientation group {100}<011> to {223}<110> is less than or equal to 2.0 and the pole density of the crystal orientation {332}<113> is less than or equal to 3.0.

3. The hot-rolled steel sheet according to claim 2, further comprising, by mass %, Nb: a content [Nb] of 0.005% to 0.06%, wherein the contents [Nb], [Ti], [N], [S], and [C] satisfy the following expression (c), $$0\%\leq[C]-12/48\times([Ti]+[Nb]\times48/93-[N]\times48/14-[S]\times48/32) \quad (c).$$

4. The hot-rolled steel sheet according to claim 2, further comprising one or two or more selected from the group consisting of, by mass %, Cu: a content [Cu] of 0.02% to 1.2%, Ni: a content [Ni] of 0.01% to 0.6%, Mo: a content [Mo] of 0.01% to 1%, V: a content [V] of 0.01% to 0.2%, Cr: a content [Cr] of 0.01% to 2%, Mg: a content [Mg] of 0.0005% to 0.01%, Ca: a content [Ca] of 0.0005% to 0.01%, REM: a content [REM] of 0.0005% to 0.1%, and B: a content [B] of 0.0002% to 0.002%.

5. The hot-rolled steel sheet according to claim 1, wherein the average grain size is less than or equal to 7 μm.

6. The hot-rolled steel sheet according to claim 5, further comprising, by mass %, Nb: a content [Nb] of 0.005% to 0.06%, wherein the contents [Nb], [Ti], [N], [S], and [C] satisfy the following expression (c), $$0\%\leq[C]-12/48\times([Ti]+[Nb]\times48/93-[N]\times48/14-[S]\times48/32) \quad (c).$$

7. The hot-rolled steel sheet according to claim 5, further comprising one or two or more selected from the group consisting of, by mass %, Cu: a content [Cu] of 0.02% to 1.2%, Ni: a content [Ni] of 0.01% to 0.6%, Mo: a content [Mo] of 0.01% to 1%, V: a content [V] of 0.01% to 0.2%, Cr: a content [Cr] of 0.01% to 2%, Mg: a content [Mg] of 0.0005% to 0.01%, Ca: a content [Ca] of 0.0005% to 0.01%, REM: a content [REM] of 0.0005% to 0.1%, and B: a content [B] of 0.0002% to 0.002%.

8. The hot-rolled steel sheet according to claim 1, further comprising, by mass %, Nb: a content [Nb] of 0.005% to 0.06%, wherein the contents [Nb], [Ti], [N], [S], and [C] satisfy the following expression (c), $$0\%\leq[C]-12/48\times([Ti]+[Nb]\times48/93-[N]\times48/14-[S]\times48/32) \quad (c).$$

9. The hot-rolled steel sheet according to claim 8, further comprising one or two or more selected from the group consisting of, by mass %, Cu: a content [Cu] of 0.02% to 1.2%, Ni: a content [Ni] of 0.01% to 0.6%, Mo: a content [Mo] of 0.01% to 1%, V: a content [V] of 0.01% to 0.2%, Cr: a content [Cr] of 0.01% to 2%, Mg: a content [Mg] of 0.0005% to 0.01%, Ca: a content [Ca] of 0.0005% to 0.01%, REM: a content [REM] of 0.0005% to 0.1%, and B: a content [B] of 0.0002% to 0.002%.

10. The hot-rolled steel sheet according to claim 1, further comprising one or two or more selected from the group consisting of, by mass %, Cu: a content [Cu] of 0.02% to 1.2%, Ni: a content [Ni] of 0.01% to 0.6%, Mo: a content [Mo] of 0.01% to 1%, V: a content [V] of 0.01% to 0.2%, Cr: a content [Cr] of 0.01% to 2%, Mg: a content [Mg] of 0.0005% to 0.01%, Ca: a content [Ca] of 0.0005% to 0.01%, REM: a content [REM] of 0.0005% to 0.1%, and B: a content [B] of 0.0002% to 0.002%.

11. A method of producing a hot-rolled steel sheet, the method comprising:

heating a steel ingot or a slab including, by mass %,

C: a content [C] of 0.02% to 0.07%,

Si: a content [Si] of 0.001% to 2.5%,

Mn: a content [Mn] of 0.01% to 4%,

Al: a content [Al] of 0.001% to 2%,

Ti: a content [Ti] of 0.015% to 0.2%,

P: a limited content [P] of 0.15% or less,

S: a limited content [S] of 0.03% or less,

N: a limited content [N] of 0.01% or less, and the balance consisting of Fe and unavoidable impurities, in which the contents [Ti], [N], [S], and [C] satisfy the following expressions (a) and (b), at SRTmin° C., which is a temperature determined according to the following expression (d) and 1150° C., to 1260° C.;

performing a first hot rolling in which reduction is performed once or more at a rolling reduction of 40% or higher per pass in a temperature range of 1000° C. to 1200° C.;

starting a second hot rolling in a temperature range of 1000° C. or higher within 150 seconds after a finish of the first hot rolling;

performing a reduction in the second hot rolling in a temperature range of (T1+30)° C. to (T1+200)° C., wherein a temperature determined by components of the steel sheet according to the following expression (e) is represented by T1° C. so as to obtain a total reduction ratio of 50% or higher, with at least one of a rolling reduction ratio of 30%;

performing a third hot rolling in which a total rolling reduction is lower than or equal to 30% in a temperature range of less than (T1+30)° C.;

finishing the hot rollings at the Ar3 transformation temperature or higher;

performing a primary cooling under conditions of a cooling rate of 50° C./sec or higher, a temperature change of 40° C. or more and 140° C. or less, and a cooling end temperature of (T1+100)° C. or lower such that a waiting time t (second) from a finish of a final pass of a large reduction pass to a start of cooling satisfies the following expression (f), wherein said large reduction pass is defined as a pass of a rolling reduction of 30% or higher in the temperature range of (T1+30)° C. to (T1+200)° C.;

performing a secondary cooling at a cooling rate of 15° C./sec or higher within 3 seconds from the finish of the primary cooling; and performing a coiling in a temperature range of 550° C. to lower than 700° C., $$0\% \leq ([Ti]-[N]\times 48/14-[S]\times 48/32) \quad (a)$$

$$0\% \leq [C]-12/48\times([Ti]-[N]\times 48/14-[S]\times 48/32) \quad (b)$$

$$SRTmin=7000/\{2.75-\log([Ti]\times[C])\}-273 \quad (d)$$

$$T1=850+10\times([C]+[N])\times[Mn]+350\times[Nb]+250\times[Ti]+40\times[B]+10\times[0]+100\times[Mo]+100\times[V] \quad (e)$$

$$t \leq 2.5\times t1 \quad (f)$$

where t1 is represented by the following expression (g), $$t1=0.001\times((Tf-T1)\times P1/100)^2-0.109\times((Tf-T1)\times P1/100)+3.1 \quad (g)$$

where Tf represents a temperature (° C.) after a final reduction at a rolling reduction of 30% or higher, and P1 represents the rolling reduction (%) during the final reduction at a rolling reduction of 30% or higher.

12. The method of producing a hot-rolled steel sheet according to claim 11, wherein the primary cooling is performed between rolling stands and the secondary cooling is performed after passage through a final rolling stand.

13. The method of producing a hot-rolled steel sheet according to claim 12, wherein the waiting time t (second) further satisfies the following expression (h), $$t1 \leq t \leq 2.5\times t1 \quad (h).$$

14. The method of producing a hot-rolled steel sheet according to claim 12, wherein the waiting time t (second) further satisfies the following expression (i), $$t<t1 \quad (i).$$

15. The method of producing a hot-rolled steel sheet according to claim 11, wherein the waiting time t (second) further satisfies the following expression (h), $$t1 \leq t \leq 2.5\times t1 \quad (h).$$

16. The method of producing a hot-rolled steel sheet according to claim 11, wherein the waiting time t (second) further satisfies the following expression (i), $$t<t1 \quad (i).$$

17. The method of producing a hot-rolled steel sheet according to claim 11, wherein a temperature increase between passes in the second hot rolling is lower than or equal to 18° C.

18. The method of producing a hot-rolled steel sheet according to claim 11, wherein the steel ingot or the slab further includes, by mass %, Nb: a content [Nb] of 0.005% to 0.06%, and the contents [Nb], [Ti], [N], [S], and [C] satisfies the following expression (c), $$0\% \leq [C]-12/48\times([Ti]+[Nb]\times 48/93-[N]\times 48/14-[S]\times 48/32) \quad (c).$$

19. The method of producing a hot-rolled steel sheet according to claim 18, wherein the steel ingot or the slab further includes one or two or more selected from the group consisting of, by mass %, Cu: a content [Cu] of 0.02% to 1.2%, Ni: a content [Ni] of 0.01% to 0.6%, Mo: a content [Mo] of 0.01% to 1%, V: a content [V] of 0.01% to 0.2%, Cr: a content [Cr] of 0.01% to 2%, Mg: a content [Mg] of 0.0005% to 0.01%, Ca: a content [Ca] of 0.0005% to 0.01%, REM: a content [REM] of 0.0005% to 0.1%, and B: a content [B] of 0.0002% to 0.002%.

20. The method of producing a hot-rolled steel sheet according to claim 11, wherein the steel ingot or the slab further includes one or two or more selected from the group consisting of, by mass %, Cu: a content [Cu] of 0.02% to 1.2%, Ni: a content [Ni] of 0.01% to 0.6%, Mo: a content [Mo] of 0.01% to 1%, V: a content [V] of 0.01% to 0.2%, Cr: a content [Cr] of 0.01% to 2%, Mg: a content [Mg] of 0.0005% to 0.01%, Ca: a content [Ca] of 0.0005% to 0.01%, REM: a content [REM] of 0.0005% to 0.1%, and B: a content [B] of 0.0002% to 0.002%.

* * * * *